US012140398B2

(12) United States Patent
Springer

(10) Patent No.: US 12,140,398 B2
(45) Date of Patent: Nov. 12, 2024

(54) ARCHERY TRIGGER ADJUSTER AND METHOD FOR ARCHERY RELEASE DEVICES

(71) Applicant: Copper John Corporation, Auburn, NY (US)

(72) Inventor: Eric C. Springer, Moravia, NY (US)

(73) Assignee: Copper John Corporation, Auburn, NY (US)

( * ) Notice: Subject to any disclaimer, the term of this patent is extended or adjusted under 35 U.S.C. 154(b) by 0 days.

(21) Appl. No.: 18/093,986

(22) Filed: Jan. 6, 2023

(65) Prior Publication Data

US 2023/0213303 A1 Jul. 6, 2023

Related U.S. Application Data

(60) Provisional application No. 63/297,112, filed on Jan. 6, 2022.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 2,819,707 A 1/1958 Kayfes et al.
3,965,884 A 6/1976 Killian
4,009,703 A 3/1977 Cunningham, Sr.
4,066,060 A 1/1978 Napier
4,316,443 A 2/1982 Giacomo
5,025,772 A 6/1991 Stevenson
5,170,771 A 12/1992 Peck
5,297,446 A * 3/1994 Krillenberger ..... H01H 37/12 74/567
5,694,915 A 12/1997 Summers
6,571,786 B2 6/2003 Summers et al.
6,584,966 B1 7/2003 Summers et al.
6,631,709 B2 * 10/2003 Carter ..... F41B 5/1469 124/35.2
6,736,124 B2 5/2004 Carter
6,945,241 B2 9/2005 Pellerite
10,641,578 B2 5/2020 Springer
11,112,206 B1 * 9/2021 Jones ..... F41B 5/1469
(Continued)

OTHER PUBLICATIONS

Various prior art releases (1) downloaded from http://www.archeryhistory.com/releases/releasespics/pse.jpg, Dec. 2009.
(Continued)

*Primary Examiner* — John A Ricci
(74) *Attorney, Agent, or Firm* — Barclay Damon LLP

(57) ABSTRACT

An archery trigger adjuster includes, in an embodiment, a tool interface portion configured to interface with a portion of an adjustment tool. The archery trigger adjuster also includes a repositioning portion coupled to the tool interface portion. The repositioning portion includes an exterior surface configured to engage a trigger surface of a trigger of an archery release device. The exterior surface has an asymmetrical shape.

20 Claims, 28 Drawing Sheets

(56) References Cited

U.S. PATENT DOCUMENTS

2012/0192844 A1 8/2012 Springer

OTHER PUBLICATIONS

Various prior art releases (2) downloaded from http://www.archeryhistory.com/releases/releasespics/release4.jpg, Dec. 2009.
Prior art releases (3) downloaded from http://www.archeryhistory.com/releases on Jul. 21, 2011.
Prior art releases (4) downloaded from http://www.archeryhistory.com/releases on Jul. 21, 2011.
Longhorn Hunter (Jan. 2010).
Carter Enterprises; Carter Whisper Tech Tip Multipurpose Rope Leash; Mar. 21, 2016; retrieved from the Internet: <https://www.youtube.com/watch?v=NkpbmDUyWTM>; 7 pages.
Carter Enterprises; Whisper; on or before Dec. 31, 2011: retrieved from the Internet: <https://carterenterprises.com/releases/thumb-trigger/whisper>; 1 page.
Carter Enterprises; 2012 Carter Catalog; on or before Dec. 31, 2012; 16 pages.
T.R.U. Ball; 2012 Product Guide; on or before Dec. 31, 2012; 20 pages.

* cited by examiner

PRIOR ART (FIGURE 37 OF U.S. PATENT NO. 10,641,578)

150

ARCHERY TRIGGER ADJUSTER AND METHOD FOR ARCHERY RELEASE DEVICES

CROSS-REFERENCE TO RELATED APPLICATION

This application is a non-provisional of, and claims the benefit and priority of, U.S. Provisional Patent Application No. 63/297,112, filed on Jan. 6, 2022. The entire contents of such application are hereby incorporated herein.

BACKGROUND

Archers use archery release aids to hold a bowstring in the drawn position. The known release aids attach to the bowstring and enable the archer to pull the bowstring to the drawn position. The user activates the release aid, either by activating a trigger or by jerking the release, to cause the bowstring to slide off of the release aid's hook, thereby enabling the bowstring to propel an arrow toward a target.

There are known release aids that include a release case, a hook and one or more linkage components coupled to the hook. Some of the known release aids have triggers coupled to the linkage components, and some of the known release aids have finger extensions with some level of adjustability.

Some of the release aids have triggers that are adjustable, such as the release device P1 of U.S. Pat. No. 10,641,578, as shown in FIG. 1. Release device P1 has a set screw P2 extending along an axis P3. As shown, the set screw P2 exhibits symmetry about the axis P3. The archer can rotate the set screw P2, causing the end of the set screw P2 to push and reposition the trigger P4 in a linear manner. This enables the archer to adjust the position of the trigger P4 relative to the hammer P5. In doing so, the archer can adjust the sensitivity of the trigger P4.

This adjustment approach depends on the pitch of the set screw P2, that is, the distance between the screw threads. Because of the symmetry of the set screw P2, this pitch remains constant throughout the rotation or turning of the set screw P2. Therefore, as the archer turns the set screw P2 through a desired travel range (e.g., two turns or 720 degrees of rotation), each incremental movement (e.g., each 360 degrees of rotation) results in the same amount of pivoting of the trigger P4. This linear adjustment method of this known design can impede the archer's ability to make minor changes to the trigger sensitivity. Also, this known design can burdensomely require a high amount of screw turns to achieve major changes to the trigger sensitivity.

These shortcomings can frustrate or impede the archer's attempt to conveniently fine tune the sensitivity of the trigger P4 to satisfy the archer's preference. As such, this can present a challenge for archers pursuing a higher level of shooting performance in accordance with their unique trigger sensitivity preferences. Also, the use of set screw P2 can require a relatively high amount of space within release aids. This can impose limits on the size, shape, quantity and function of components of the release aids, which, in turn, can limit the functionality and features of release aids.

The foregoing background describes some, but not necessarily all, of the problems, disadvantages and shortcomings related to the known archery release aids.

SUMMARY

An embodiment of an archery trigger adjuster includes a tool interface portion that is compatible with a portion of an adjustment tool and a repositioning portion that is coupled to the tool interface portion. The repositioning portion includes an exterior surface that is configured to engage a trigger surface of a trigger of an archery release device and an asymmetrical shape that is at least partially defined by the exterior surface. The repositioning portion is configured to at least partially rotate in response to the tool interface portion being rotated. The repositioning portion is further configured to undergo a rotational travel that comprises a plurality of rotational movements that are equal in magnitude. When the exterior surface of the repositioning portion is engaged with the trigger surface, the exterior surface is configured so that, during the rotational travel, the rotational movements cause different amounts of pivoting responses by the trigger.

A further embodiment of the archery trigger adjuster includes a tool interface portion that is configured to interface with a portion of an adjustment tool and a repositioning portion coupled to the tool interface portion. The repositioning portion includes an exterior surface that is configured to engage a trigger surface of a trigger of an archery release device, and the exterior surface comprises an asymmetrical shape.

An embodiment of a method for manufacturing an archery trigger adjuster includes structuring a tool interface portion to be interfaced with a portion of an adjustment tool and structuring a repositioning portion to comprise an exterior surface. The exterior surface is structured so that the exterior surface is configured to engage a trigger surface of a trigger of an archery release device, and the exterior surface comprises an asymmetrical shape. The method further includes coupling the repositioning portion to the tool interface portion.

The above embodiments are exemplary only. Other embodiments as described herein are within the scope of the disclosed subject matter.

BRIEF DESCRIPTION OF THE DRAWINGS

So that the manner in which the features of the disclosure can be understood, a detailed description may be had by reference to certain embodiments, some of which are illustrated in the accompanying drawings. It is to be noted, however, that the drawings illustrate only certain embodiments and are therefore not to be considered limiting of its scope, for the scope of the disclosed subject matter encompasses other embodiments as well. The drawings are not necessarily to scale, emphasis generally being placed upon illustrating the features of certain embodiments. In the drawings, like numerals are used to indicate like parts throughout the various views, in which.

DETAILED DESCRIPTION

Throughout this disclosure set forth herein, the word "including" indicates or means "including, without limitation," the word "includes" indicates or means "includes, without limitation," the phrases "such as" and "e.g." indicate or mean "including, without limitation," and the phrase "for example" refers to a non-limiting example.

Figure 1:
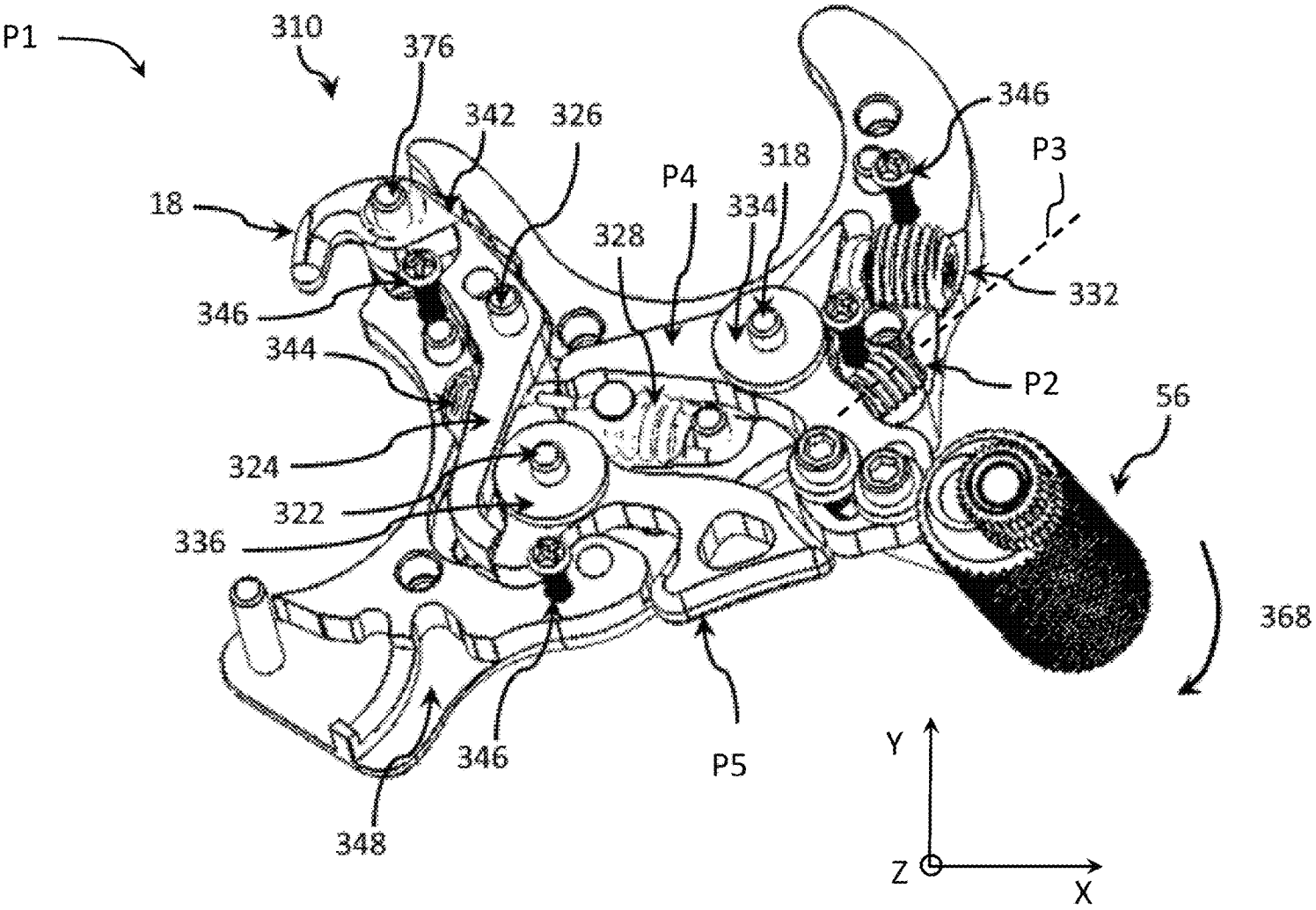
FIG. 1 is an isometric side view of a prior art archery release device with a portion of its body or housing removed.
Figure 2:
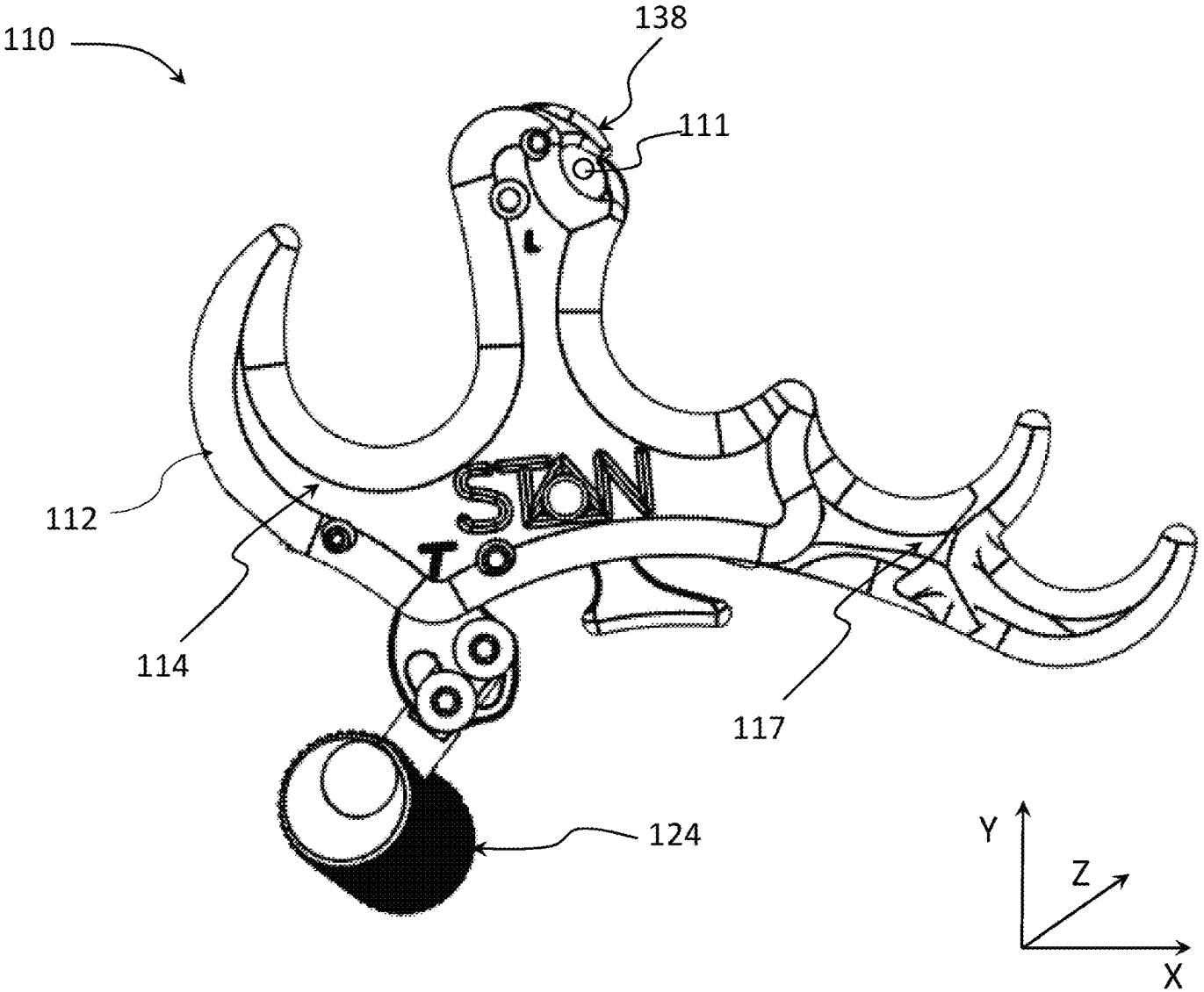
FIG. 2 is a first side view of an embodiment of an archery release device according to the following disclosure.
Figure 3:
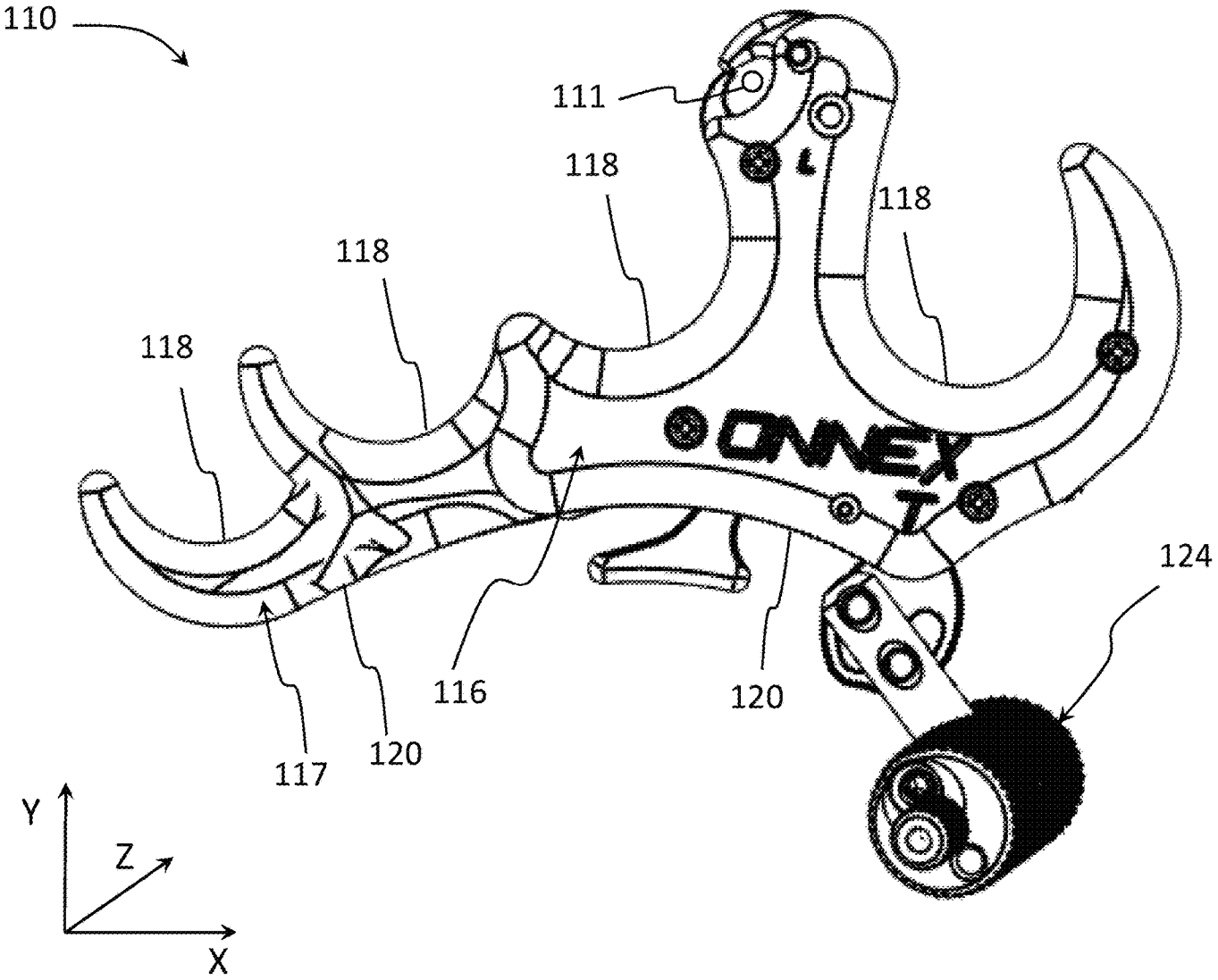
FIG. 3 is a second side view of the embodiment of the embodiment of FIG. 2.
Figure 4:
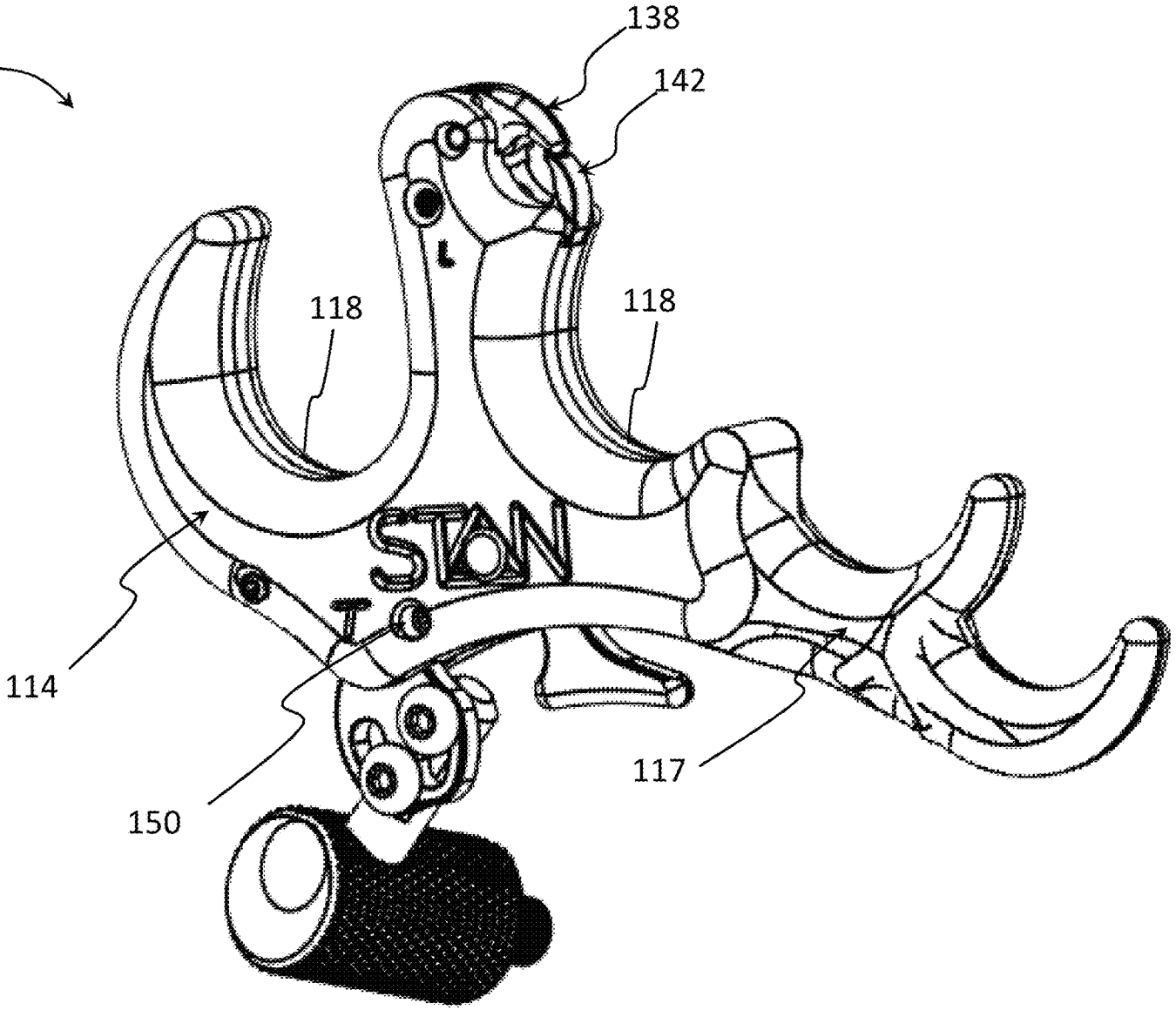
FIG. 4 is an isometric side view of the embodiment of the embodiment of FIG. 2.

As illustrated in FIGS. 2-4, in an embodiment, an archery release device 110 is usable to retract and release a bowstring or draw cord 111 of an archery shooting device, such as an archery bow, including a compound bow, a recurve bow and a fishing bow. The archery release device 110 includes a case, housing or body 112 having a right side panel 114 and a left side panel 116 configured to be joined with the right side panel 114. The archery release device 110 also includes a grasp 117 having finger interface surfaces configured to engage a plurality of fingers of the archer. When joined or fastened together, the side panels 114, 116 in conjunction with the grasp 117 collectively define a front surface 118 and a rear surface 120. In use, the front surface 118 faces toward a target, and the rear surface 120 faces the archer in a direction opposite of the target.

Figure 5:
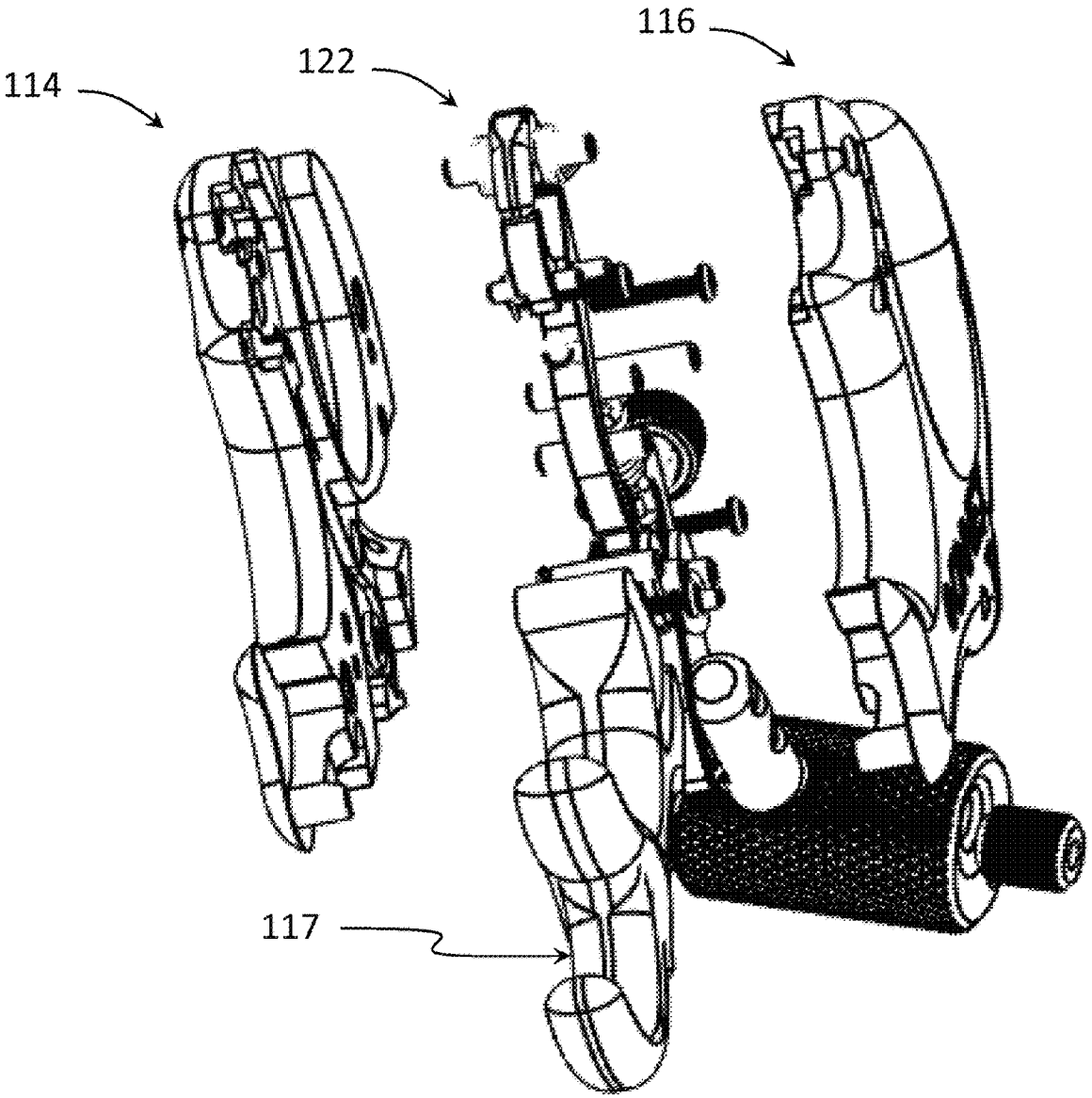
FIG. 5 is a partially exploded view of the embodiment of the embodiment of FIG. 2 where the right and left side panels of the body have been removed from the linkage assembly.
Figure 6:
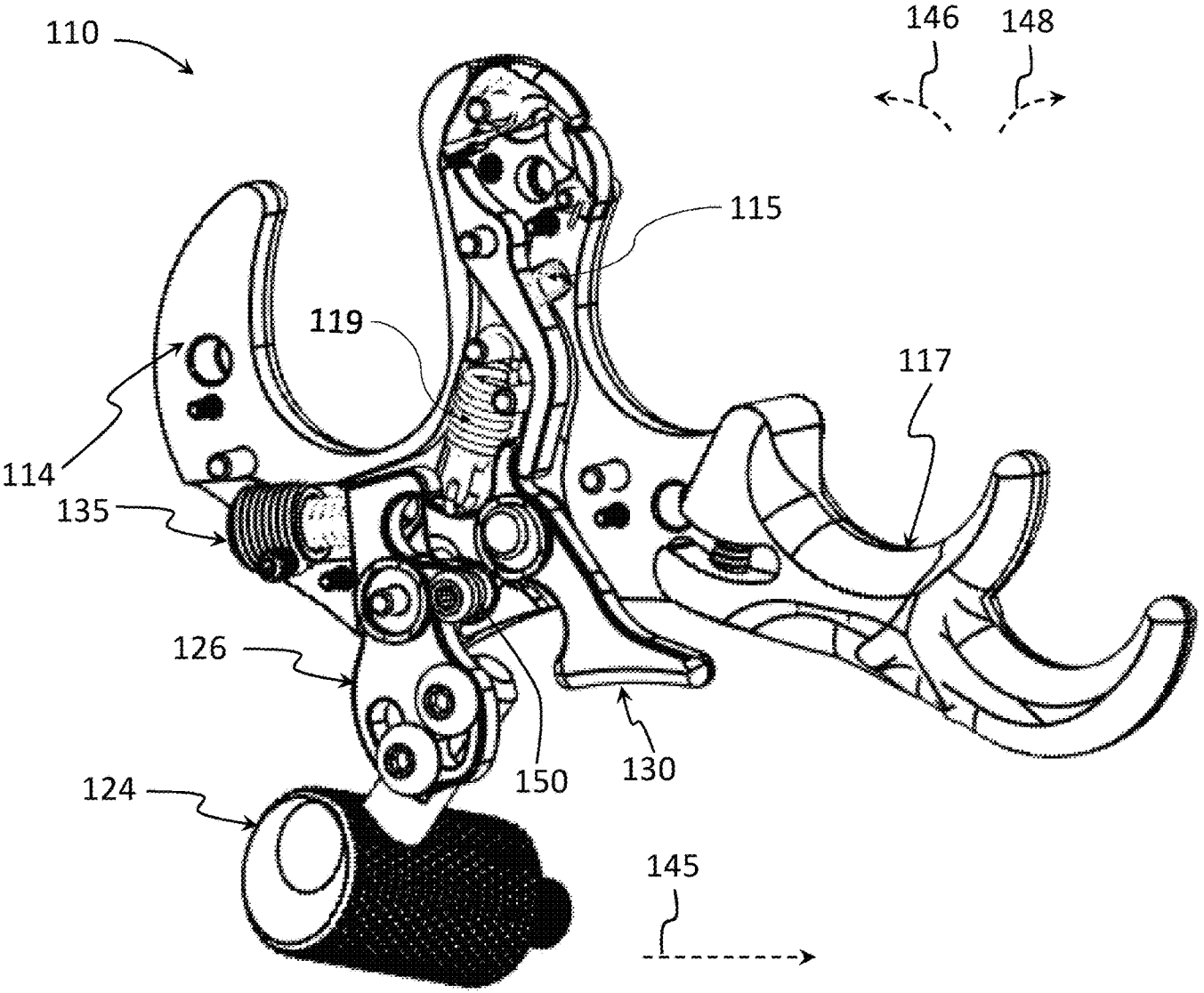
FIG. 6 is a side isometric view of an embodiment of the linkage assembly of the embodiment of FIG. 2 that is coupled to the right side panel of the body.
Figure 7:
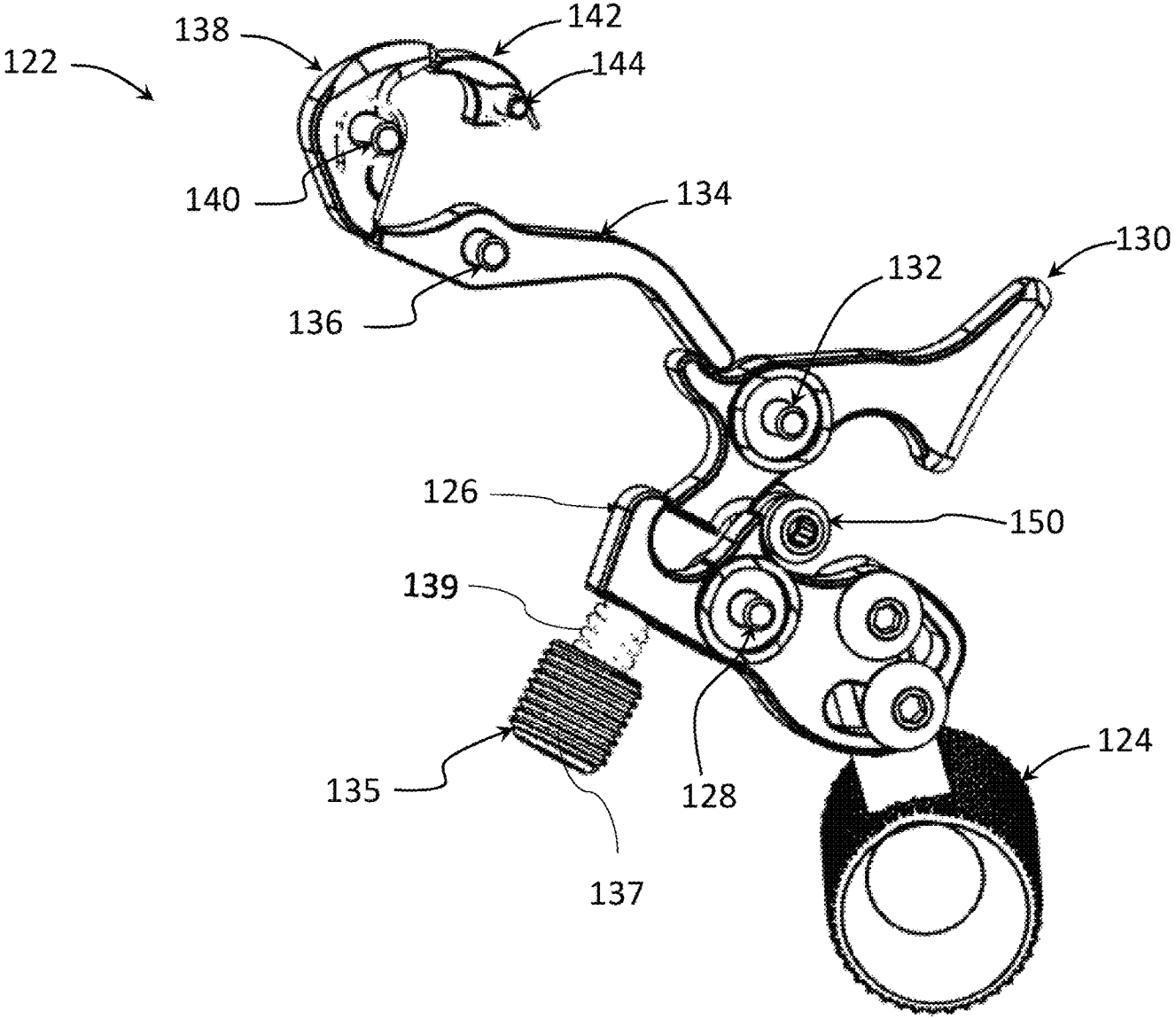
FIG. 7 is a side view of the linkage assembly of the embodiment of FIG. 6.

As shown in FIGS. 5-7, the archery release device 110 includes a linkage assembly 122 coupled to the body 112 (see FIG. 2). In the embodiment shown, the linkage assembly 122 includes: (a) a trigger grasp 124 engagable by the archer's thumb or other fingers, (b) a trigger 126 pivotally coupled to the body 112 (being pivotable about a trigger pivot member 128) and also coupled to the trigger grasp 124; (c) a driver or hammer 130 pivotally coupled to the body 112, being pivotable about a hammer pivot member 132; (d) a stay arm or retainer arm 134 pivotally coupled to the body 112, being pivotable about a retainer pivot member 136; (e) a primary bowstring hook, primary cord hook or primary cord holder 138 pivotally coupled to the body 112, being pivotal about a primary pivot member 140; and (f) a secondary bowstring hook, secondary cord hook or secondary cord holder 142 pivotally coupled to the body 112, being pivotal about a secondary pivot member 144. The archery release device 110 also includes a plurality of biasing members 115, 119 (e.g., springs) that apply biasing forces to different portions of the linkage assembly 122.

In the embodiment shown, the archery release device 110 includes a trigger pressurizer 135. The trigger pressurizer 135 includes a set screw 137 threadably engaged with the body 112. The trigger pressurizer 135 also includes a spring 139 between the set screw and the trigger 126. By screwing or unscrewing the trigger pressurizer 135, the archer can adjust the level of spring force or pressure applied to the trigger 126.

When the archery release device 110 is in a retention condition, holding the draw cord 111 (see FIGS. 2 and 3), the trigger 126 is engaged with the hammer 130, the hammer 130 is engaged with the retainer arm 134, the retainer arm 134 is engaged with the primary cord holder 138, and the primary cord holder 138 is engaged with the secondary cord holder 142, entrapping the draw cord 111 (see FIGS. 2 and 3). In operation of the archery release device 110, at least partially based on the biasing forces by the biasing members 115, 119, the archer's pulling of the trigger grasp 124 in an activation direction 145 causes the following to occur: (a) the trigger 126 rotates counterclockwise 146 until the trigger 126 disengages (and loses contact with) the hammer 130; (b) the hammer 130 rotates clockwise 148, which causes the retainer arm 134 to rotate counterclockwise 146 until the retainer arm 134 disengages (and loses contact with) the primary cord holder 138; (c) the primary cord holder 138 consequently pivots counterclockwise 146 causing the primary cord holder 138 to disengage (and lose contact with) the secondary cord holder 142, resulting in a gap between the primary and secondary cord holders 138, 142, at which point the archery release device 110 is in a release condition; and (d) due to the forward pulling force imparted on the draw cord 111 (see FIGS. 2 and 3) by the archery bow, the draw cord 111 (see FIGS. 2 and 3) becomes freed or released, passing through such gap.

Figure 8:
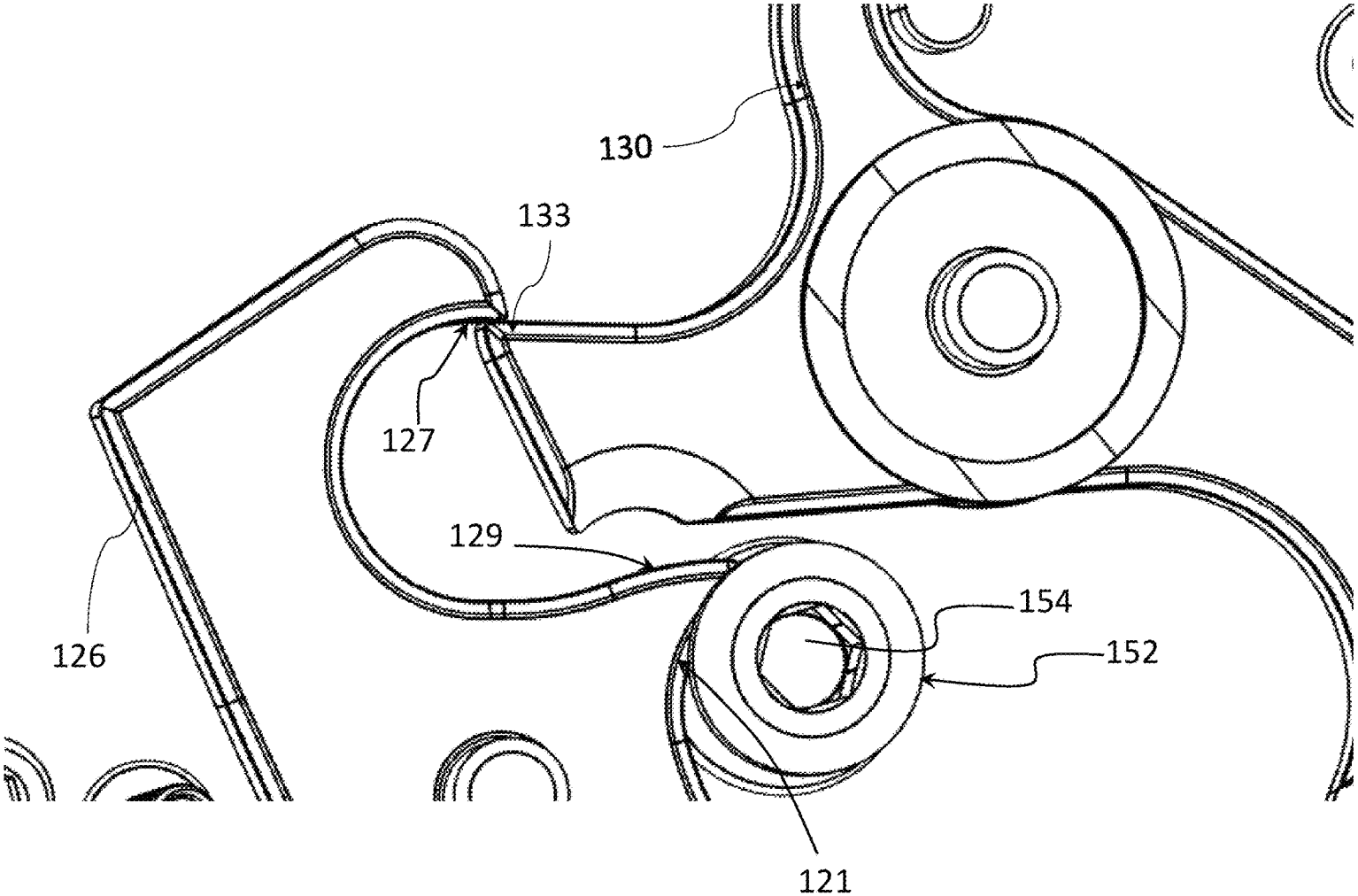
FIG. 8 is a close-up, enlarged view of a portion of the linkage assembly of FIGS. 6 and 7.
Figure 9:
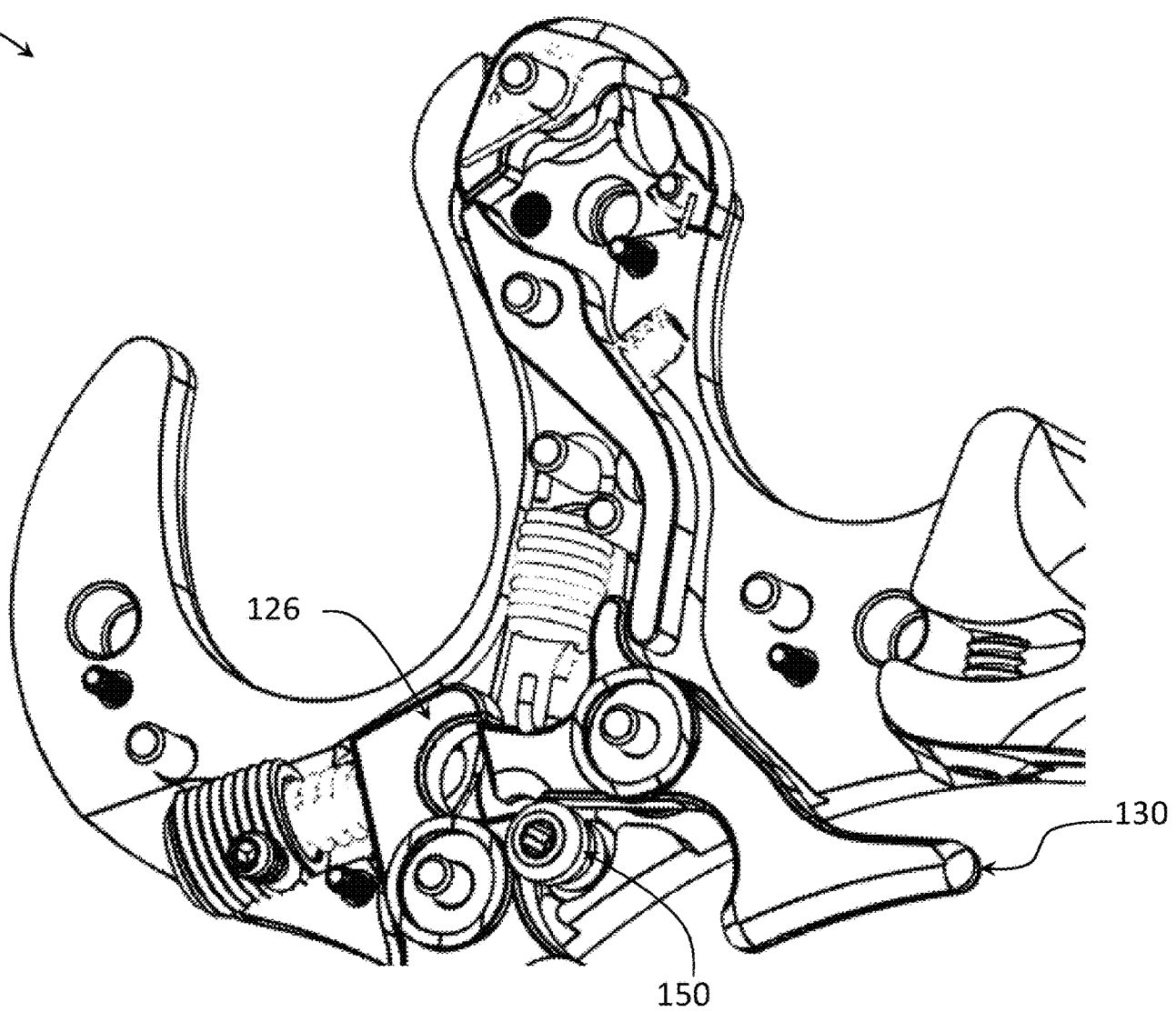
FIG. 9 is a side view of the linkage assembly of FIGS. 6-8 coupled to the right side panel of the body.
Figure 10:
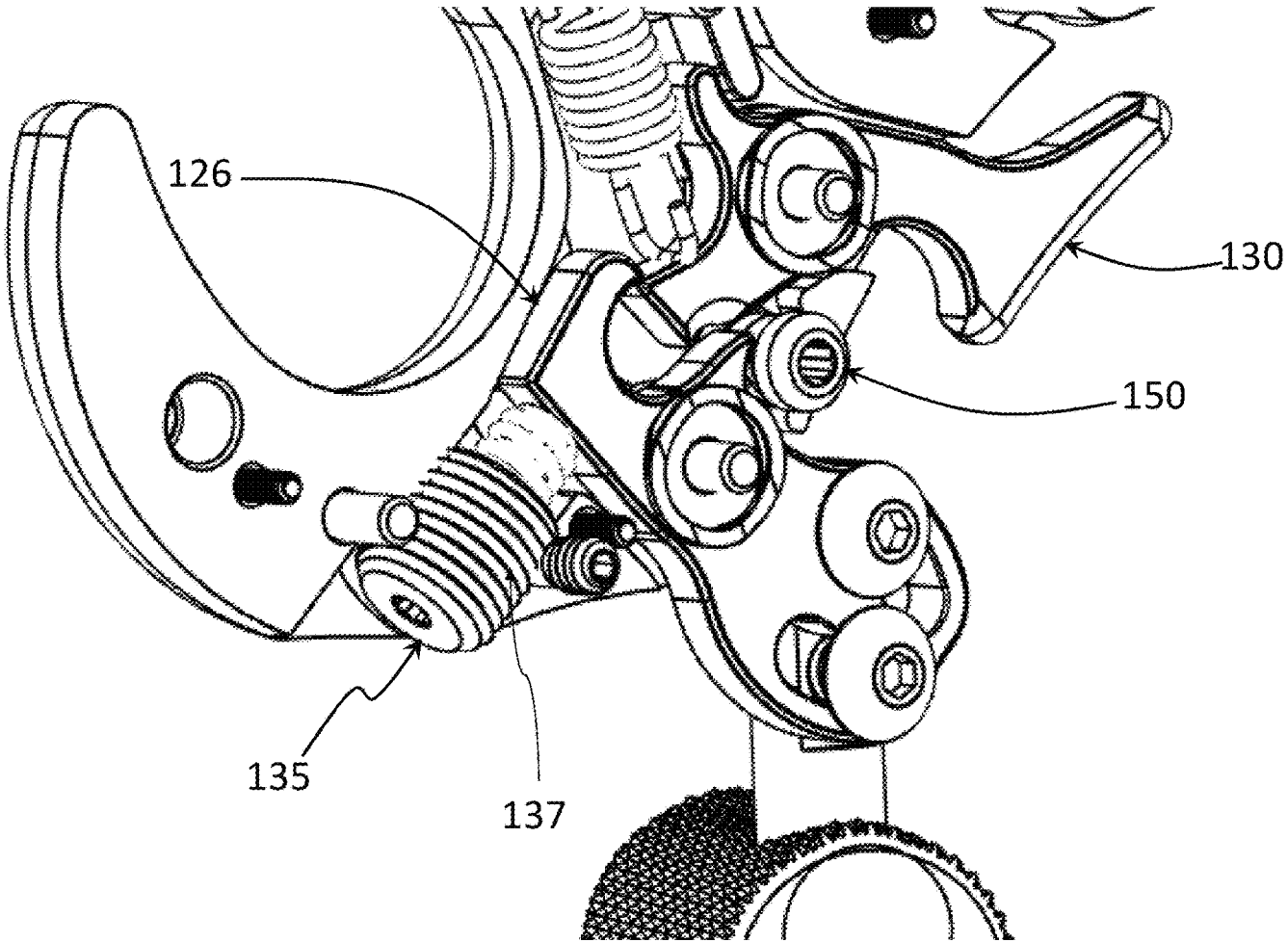
FIG. 10 is a side isometric close-up view of a portion of the embodiment of FIG. 9, showing the hammer and trigger of the linkage assembly.
Figure 11:
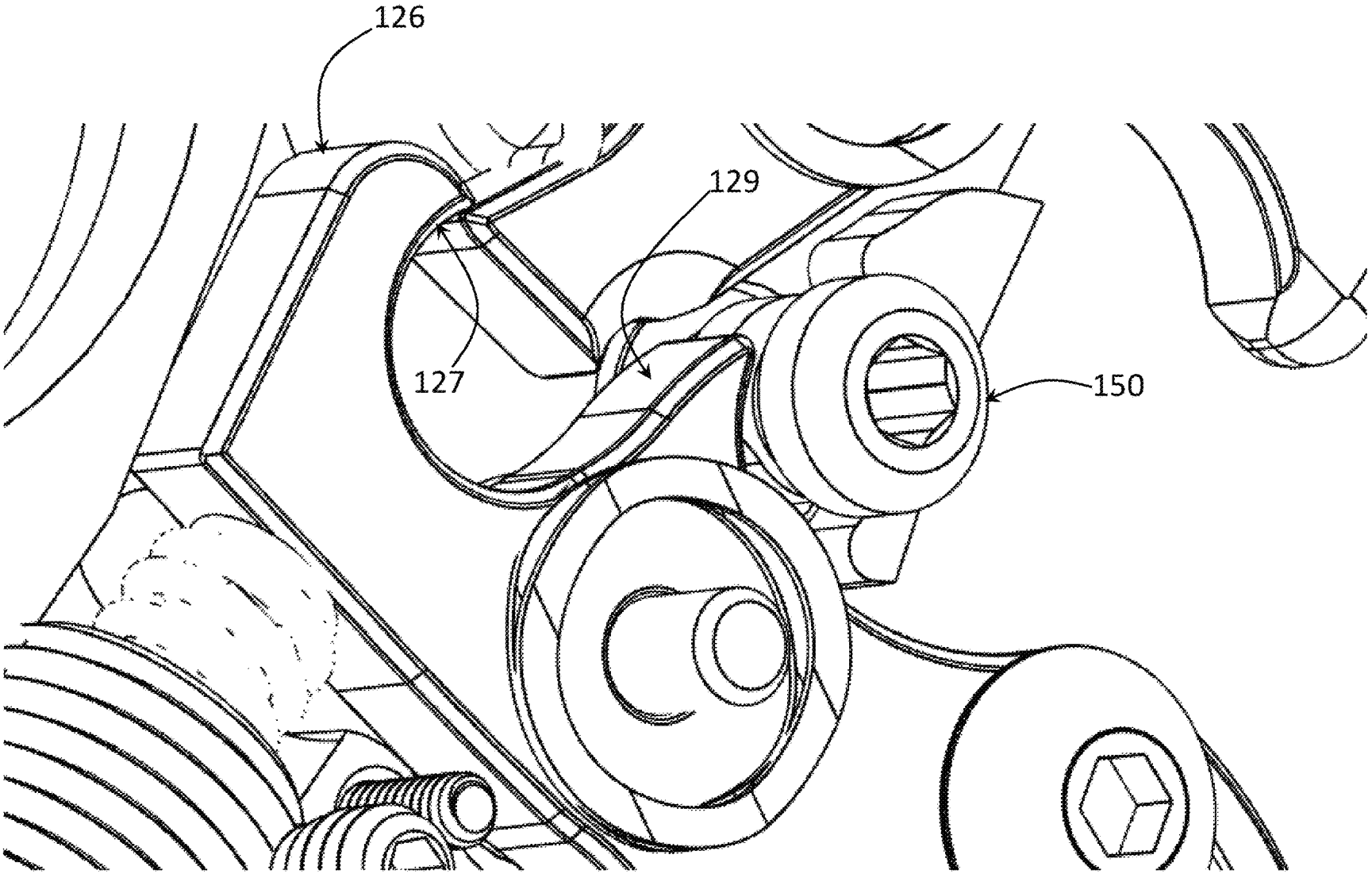
FIG. 11 is a side isometric close-up view of a portion of the embodiment of FIG. 10, showing an embodiment of the trigger adjuster including a head end.
Figure 12:
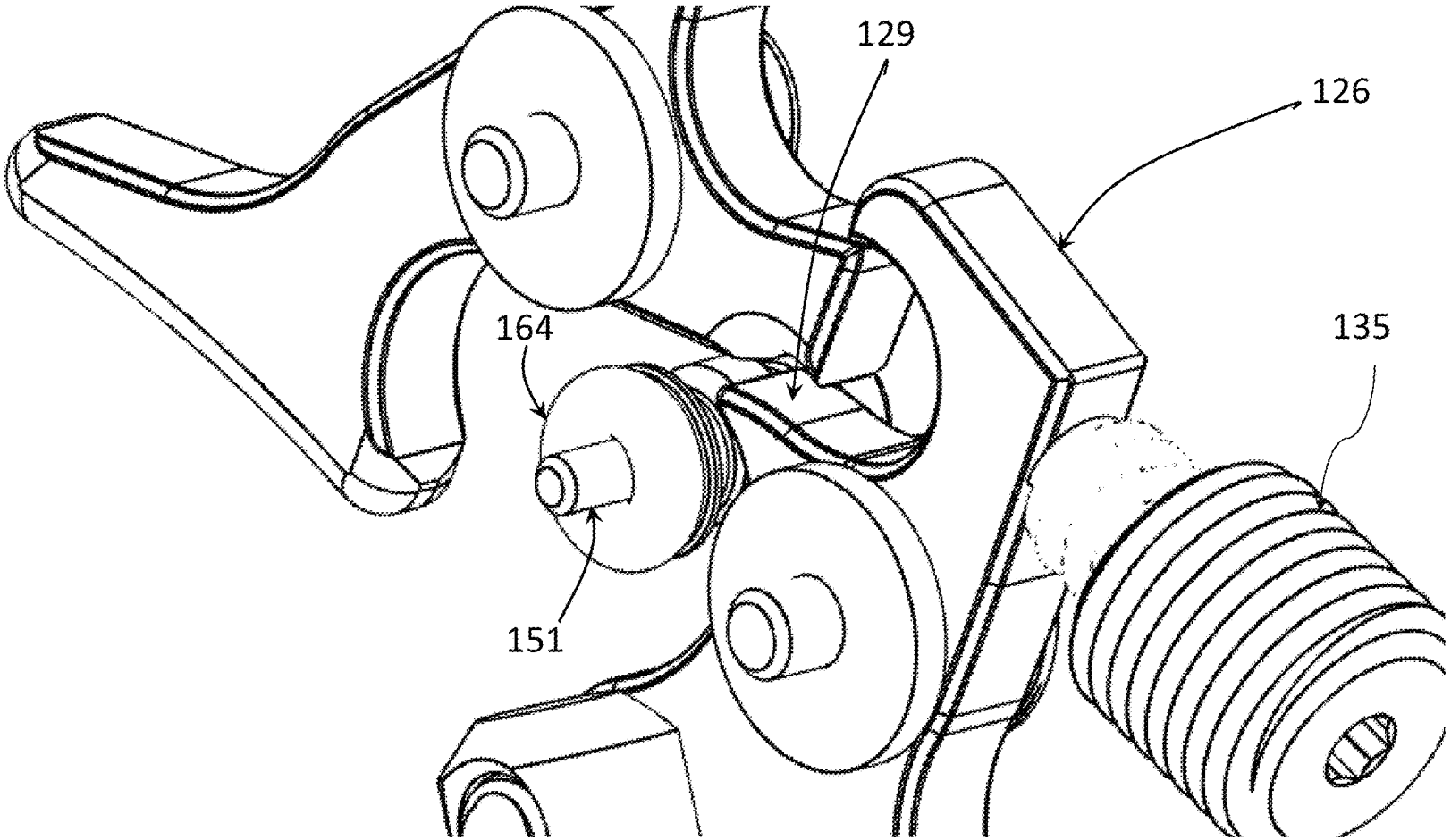
FIG. 12 is another side isometric close-up view of the trigger adjuster, showing an end opposing the head end including a biasing member.
Figure 13:
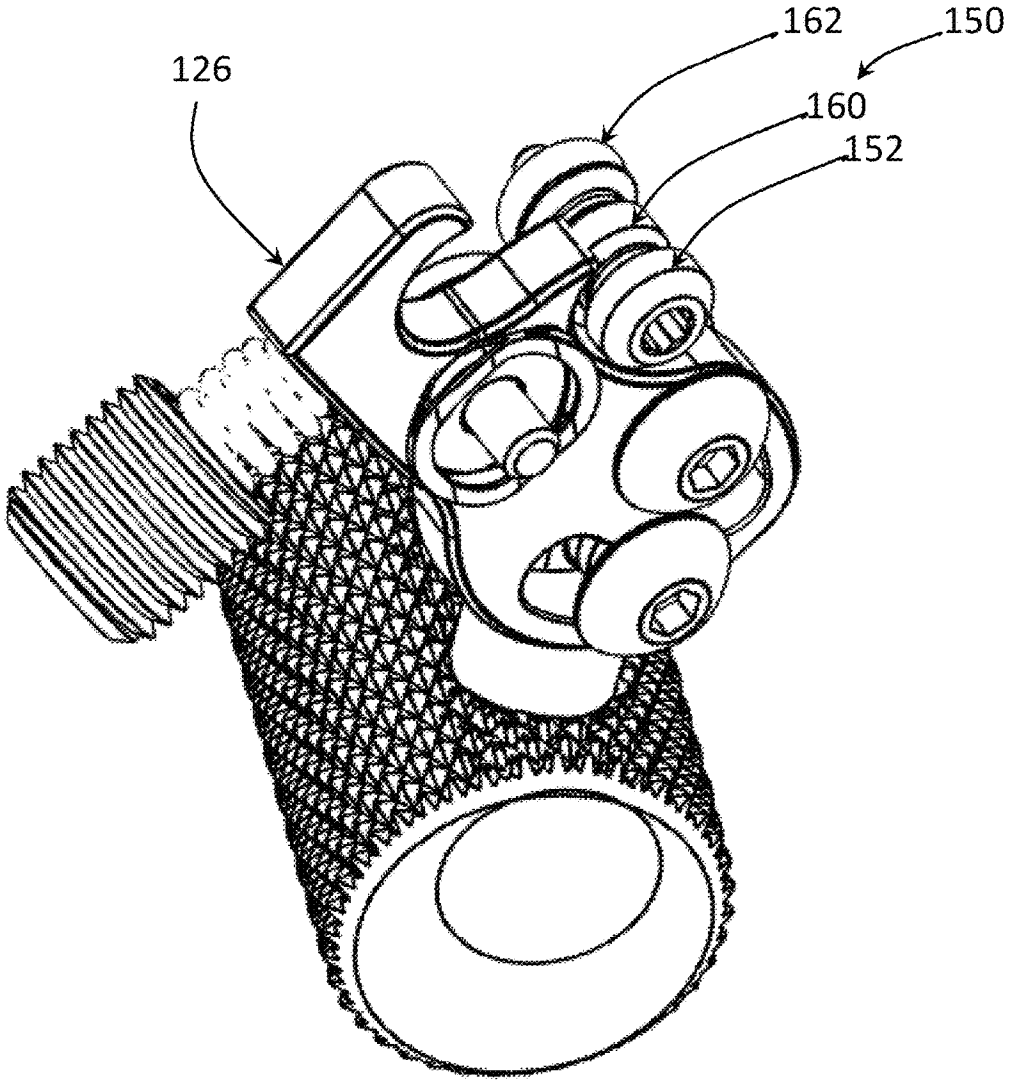
FIG. 13 is a side isometric view of a portion of the archery release device showing the trigger adjuster of FIGS. 11 and 12 in contact with a portion of the trigger.
Figure 14:
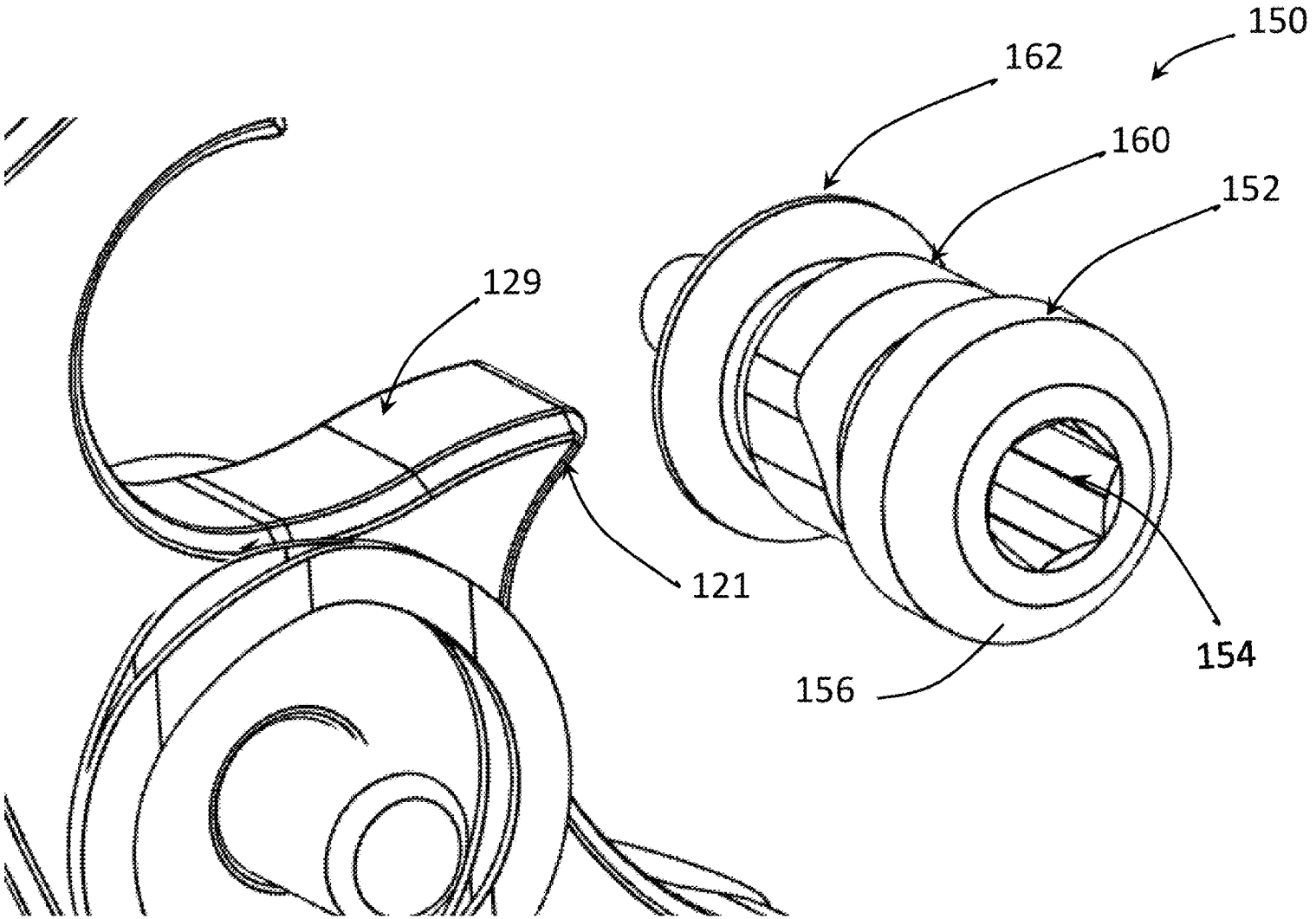
FIG. 14 is a close-up isometric view of the trigger adjuster of FIGS. 11-13 and a portion of the trigger.
Figure 15:
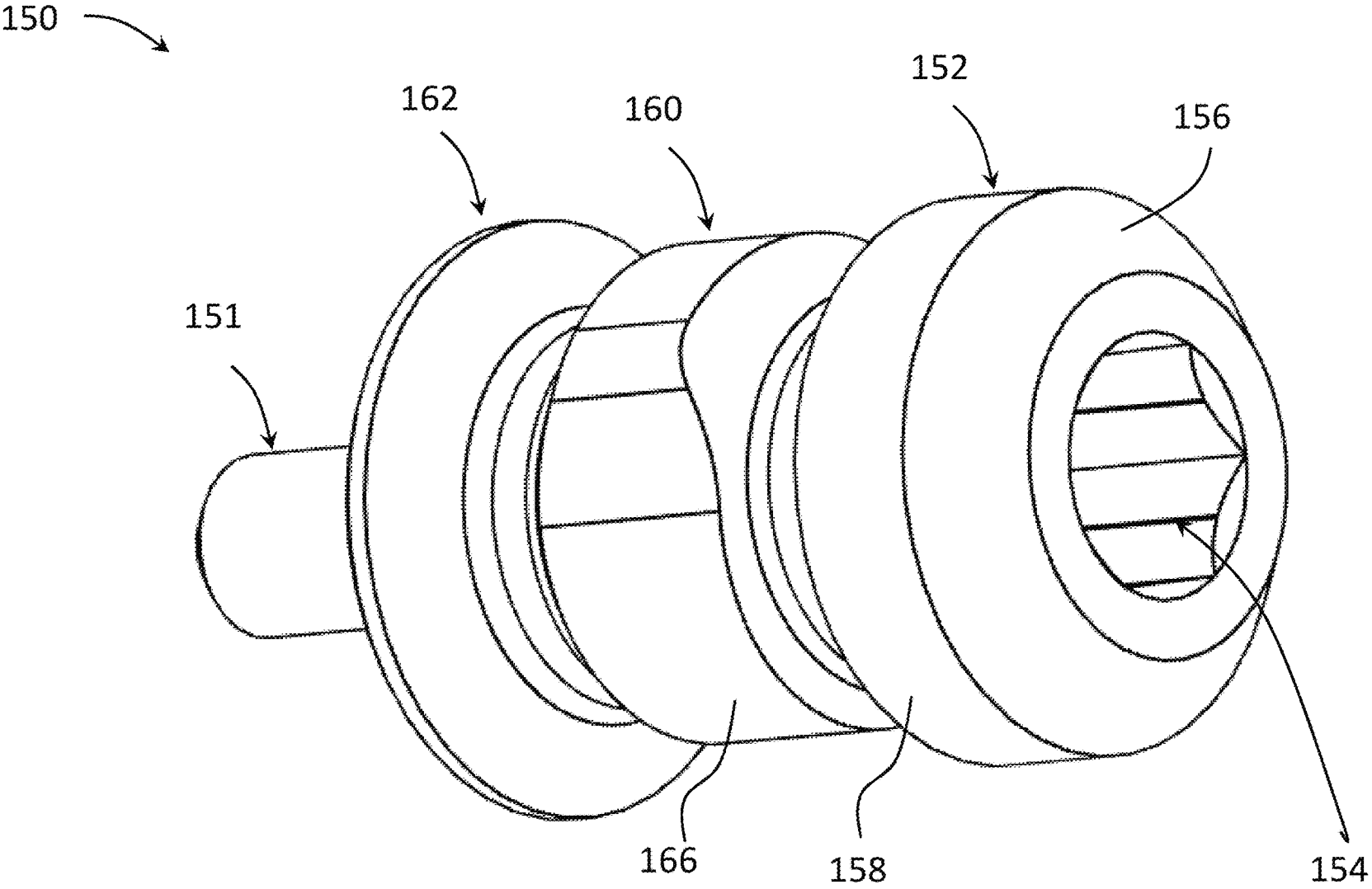
FIG. 15 is a top isometric view of the trigger adjuster of FIGS. 11-14.
Figure 16:
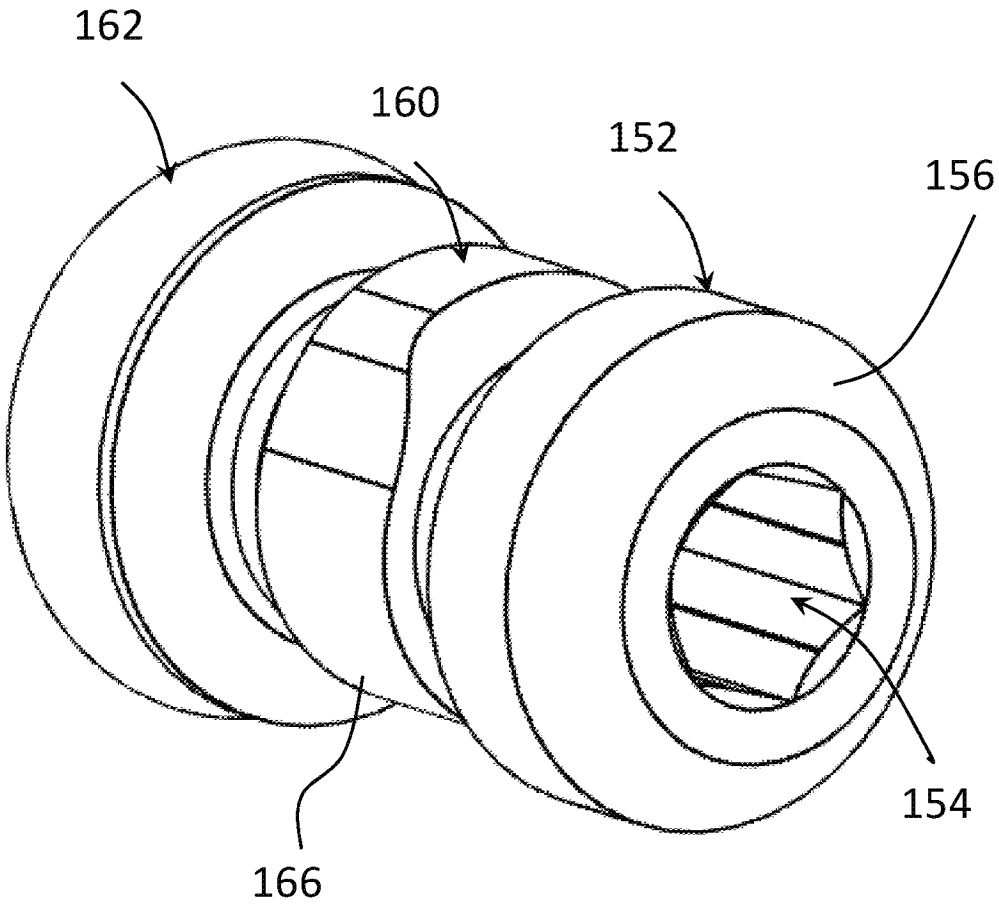
FIG. 16 is another top isometric view of the trigger adjuster of FIGS. 11-15.
Figure 17:
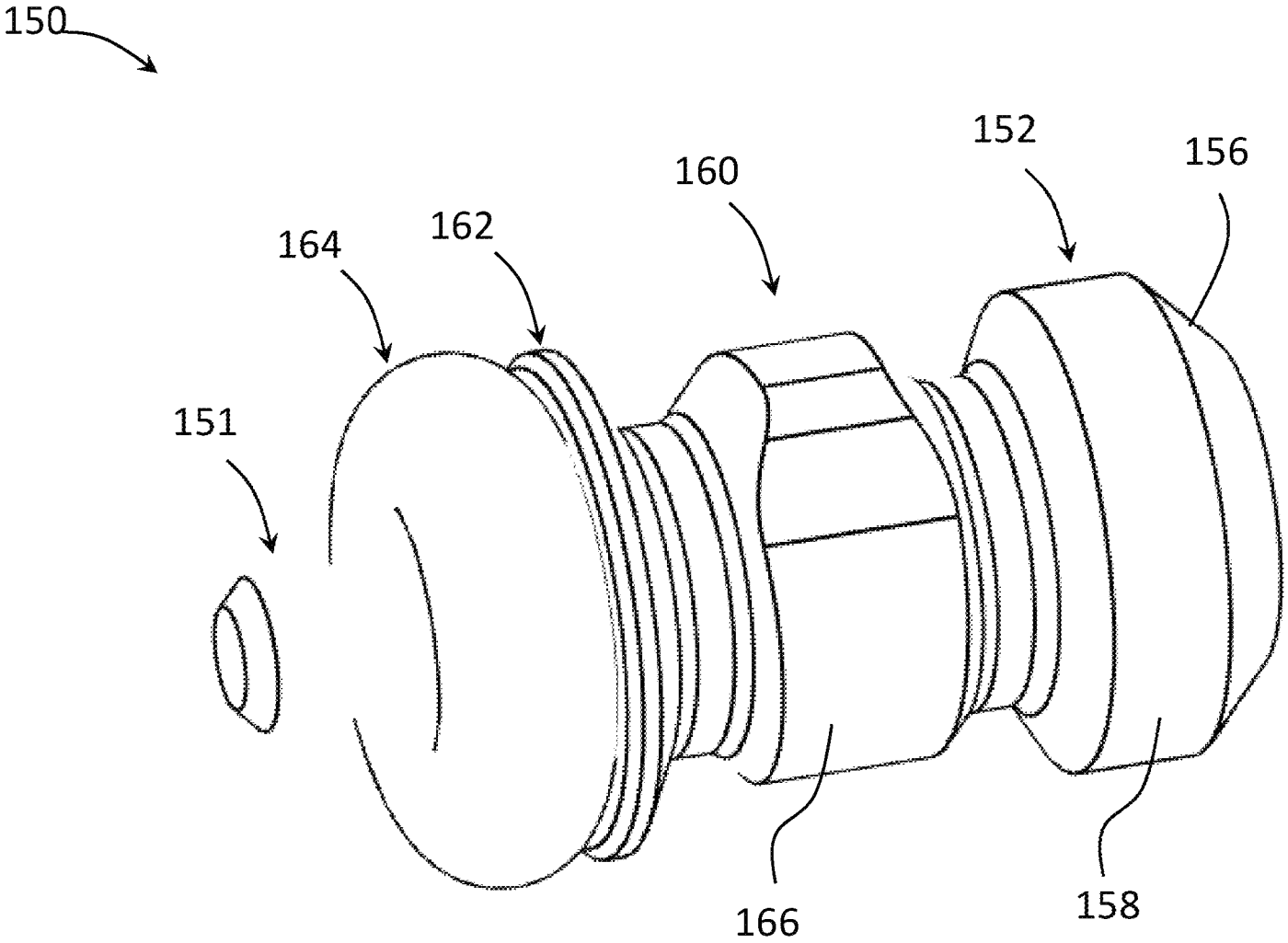
FIG. 17 is a side view of the trigger adjuster of FIGS. 11-16.

As shown in FIG. 8, the trigger 126 includes a first trigger surface or trigger action interface 127 and a trigger adjustment finger 129, which includes a second trigger surface or a trigger adjustment interface 121. The hammer 130 includes a hammer action interface 133 configured and positioned to slidably engage (and make contact with) the trigger action interface 127. When engaged, the trigger action interface 127 overlaps with the hammer action interface 133. To completely disengage from the hammer action interface 133, the trigger action interface 127 must translate or travel a designated distance relative to the hammer action interface 133. The time spent during this travel results in a trigger delay or trigger lag time. This trigger lag time is part of the overall release response time, which begins the moment the archer pulls or actuates the trigger grasp 124, and the response time ends the moment the archery release device 110 releases the draw cord 111 (see FIGS. 2 and 3). The greater the trigger lag time, the greater the overall release response time.

Some archers prefer shorter release response times than others. It is advantageous for archers to have increased customization of the trigger lag time to conform to the archers' unique shooting preferences. As described below, the archery trigger adjuster 150 facilitates such customization.

As shown in FIGS. 8-21, the archery release device 110 includes the trigger sensitivity controller, trigger pivot adjuster or archery trigger adjuster 150. The archery trigger adjuster 150 is configured and positioned to engage the trigger adjustment interface 121. Referring to FIGS. 12-19, the archery trigger adjuster 150 includes: (a) a rod, shaft, pin or extension member 151; (b) a head 152, connected to the extension member 151, having a tool receiver or tool interface portion 154 configured to receive and mate with a portion of an adjustment tool (e.g., a hex key or screw driver), an angled head surface 156 configured to set or fix the Z axis position (see FIGS. 2 and 3) of the archery trigger adjuster 150, as described below, and a side surface 158 configured to set or fix the Y axis position (see FIGS. 2 and 3) of the archery trigger adjuster 150, as described below; (b) an offset member, cam member, repositioner or repositioning portion 160, connected to the extension member 151, configured to engage the trigger adjustment interface 121; (c) a retainer 162 connected to the extension member 151; and (d) a stabilizer or biasing member 164 that is received by and fits onto the extension member 151. In an embodiment, the extension member 151, head 152, repositioning portion 160 and retainer 162 are integrated together into a single, unitary device. The head 152 and retainer 162 are spaced apart to at least partially surround the trigger adjustment finger 129.

Figure 18:
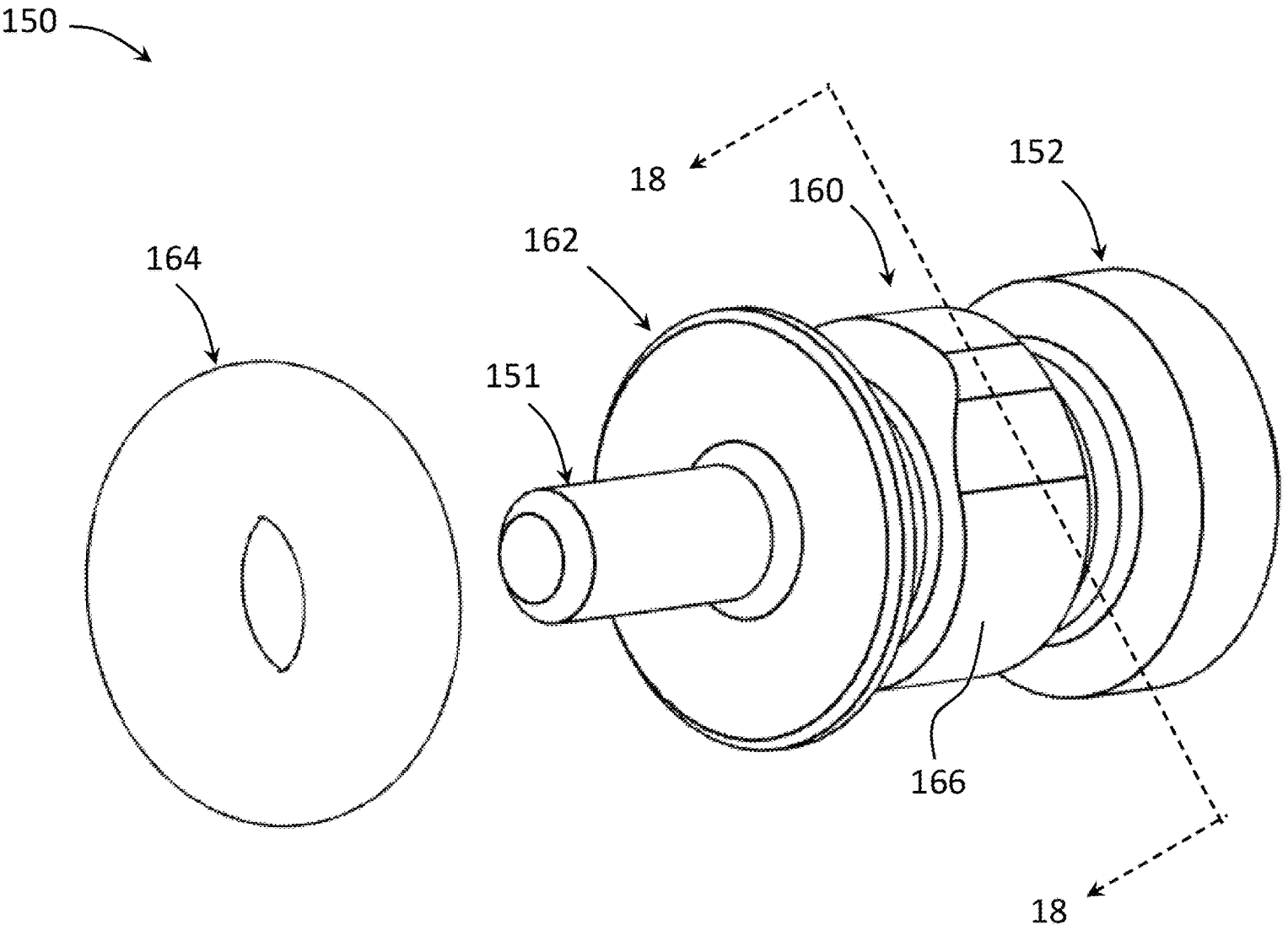
FIG. 18 is a side isometric view of the trigger adjuster of FIGS. 11-17 with the biasing member detached.
Figure 19:
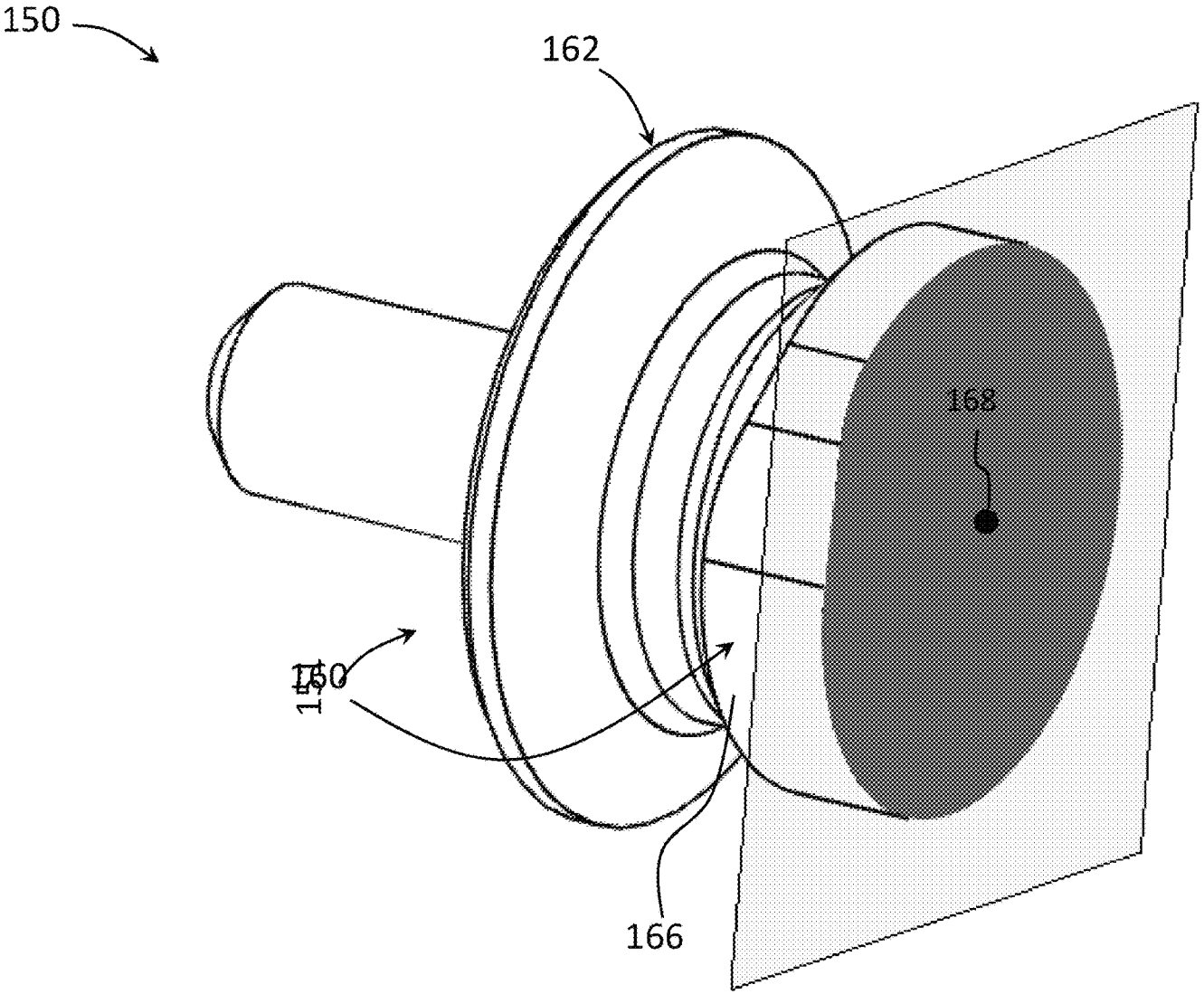
FIG. 19 is a cross-sectional view of an embodiment of the repositioning portion of the trigger adjuster taken substantially along the cross-sectional line 18-18 of FIG. 18.
Figure 20A:
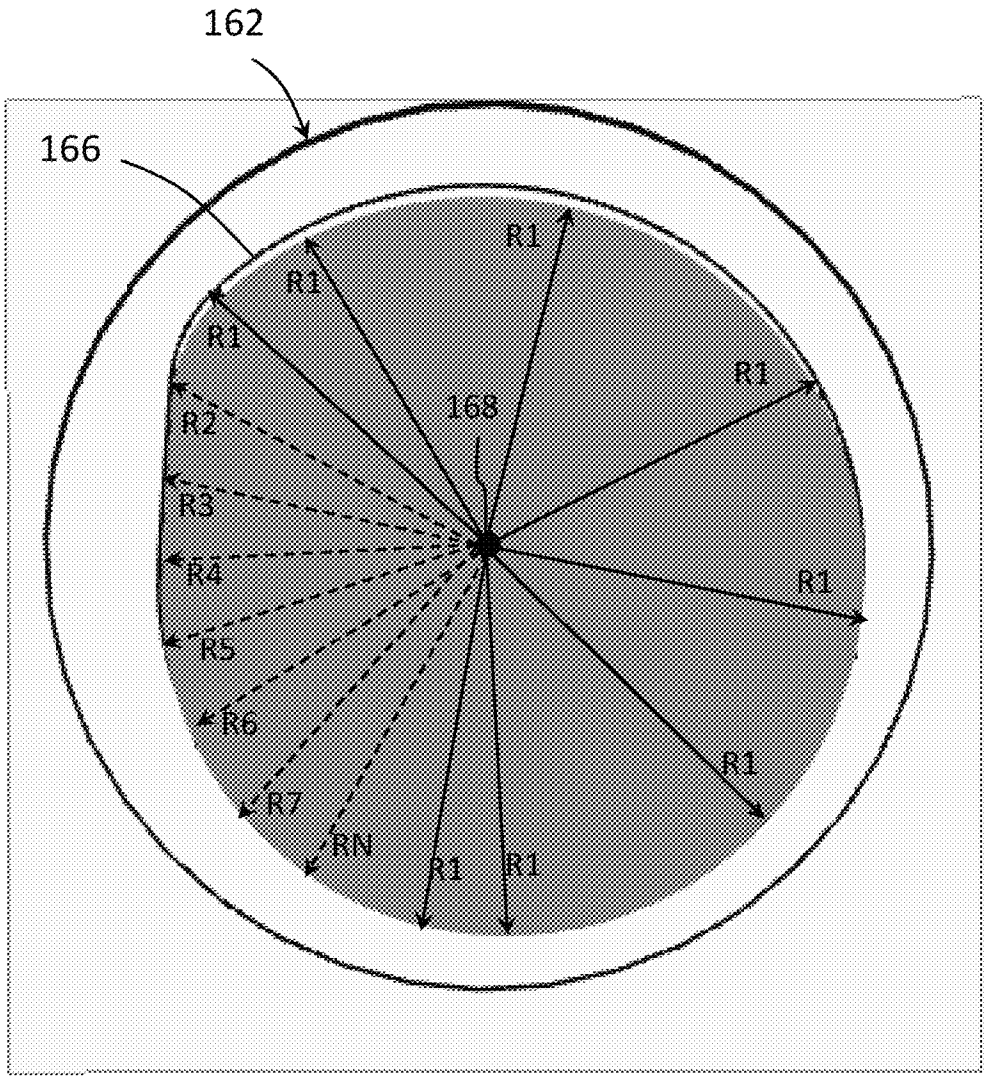
FIG. 20A is an enlargement of the cross-sectional view of FIG. 19, illustrating the asymmetric shape and geometry of the exterior surface of the trigger adjuster, including its radii of different lengths.
Figure 20B:
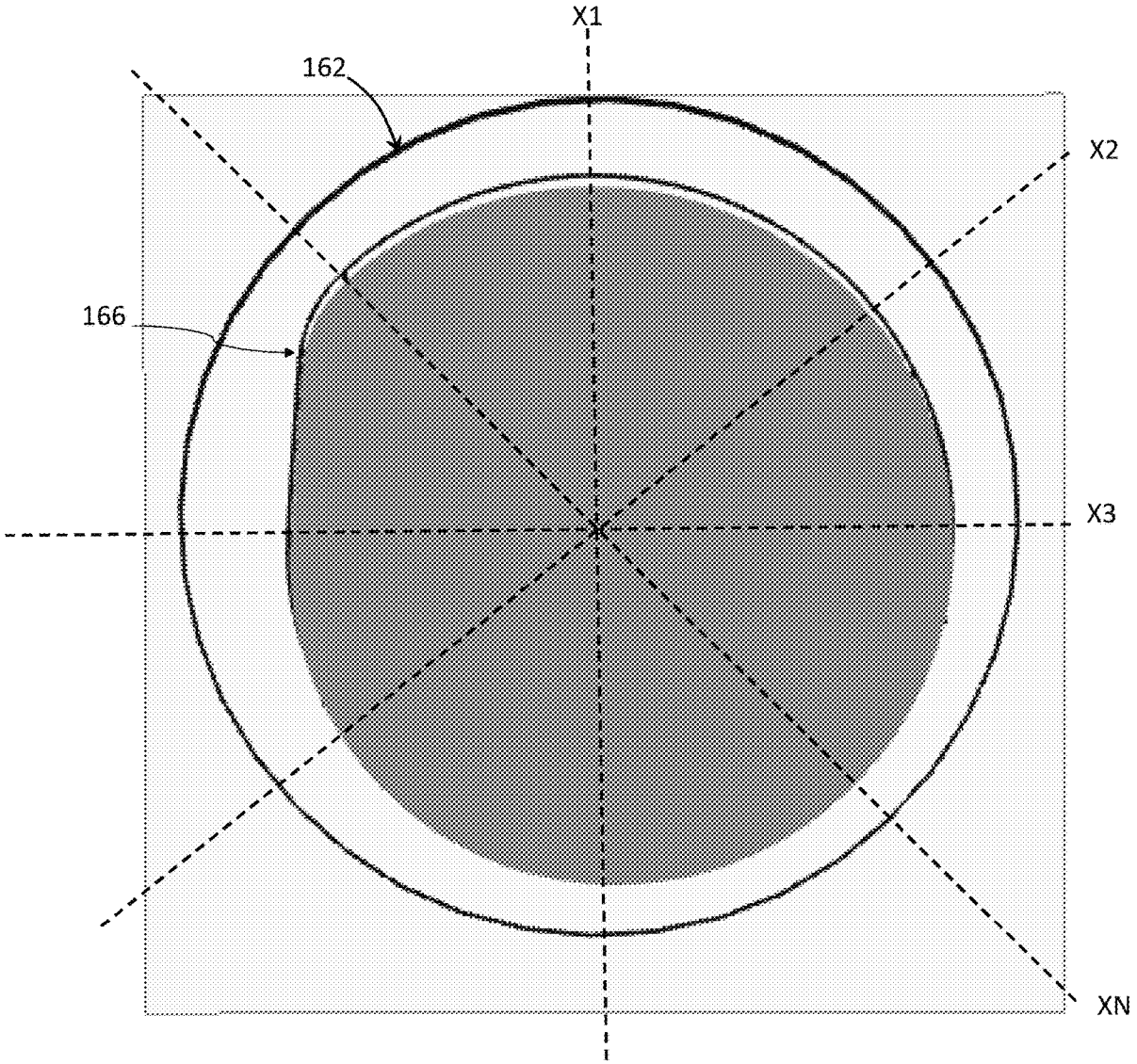
FIG. 20B is the cross-sectional view of FIG. 20A illustrating the lack of symmetry about a plurality of symmetry lines.
Figure 20C:
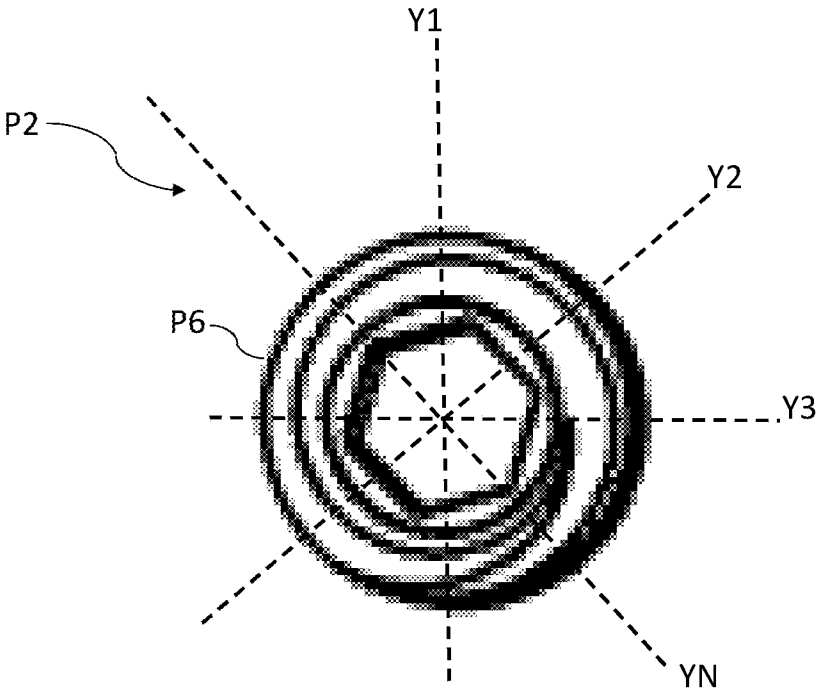
FIG. 20C is a front view of the embodiment of the prior art set screw illustrating the symmetric shape of the exterior surface of the prior art set screw about a plurality of symmetry lines.
Figure 21:
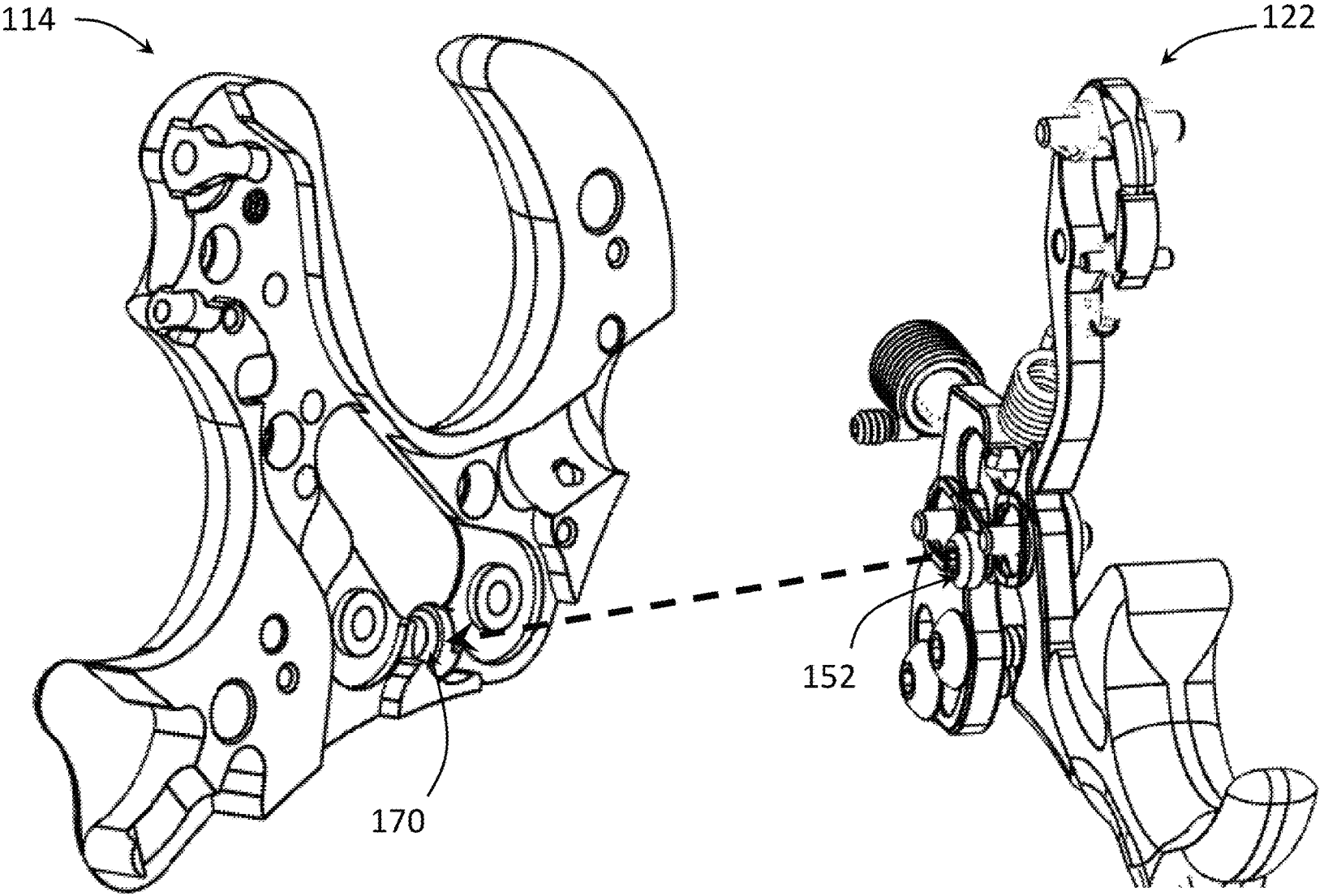
FIG. 21 is an isometric view of the right side panel of the housing separated from the linkage assembly and further showing an embodiment of a structure of the right housing that mates with a portion of the trigger adjuster.

Referring specifically to FIGS. 18-20A, FIG. 19 is a cross-sectional view of the repositioning portion 160, taken substantially along line 18-18 of the embodiment of FIG. 18. FIG. 20 is a front view of the cross-sectional portion of the repositioning portion 160 shown in FIG. 19. As illustrated in FIG. 20B, the exterior surface 166 of the repositioning portion 160 has a cam shape, an asymmetrical shape or otherwise lacks symmetry relative to a symmetry line or symmetry plane that passes through and extends along the diameter X1, X2, X3, . . . , XN of the repositioning portion 160. Referring to FIG. 20C, by way of a non-limiting example, an object, such as the prior art set screw P2 has a symmetrical shape P6 when a line of symmetry can be drawn to divide an object into two identical pieces. The prior art set screw P2 shown in FIG. 20C can be divided, by a plurality of lines of symmetry (Y1, Y2, Y3, . . . , YN), each of which divide the prior art set screw P2 in to two identical halves. In contrast, an object, such as repositioning portion 160 has a cam shape or an asymmetrical shape when a line of symmetry cannot be drawn to divide the object into two identical pieces. The repositioning portion 160, in an embodiment, has a plurality of radii of different lengths so that none of the symmetry lines or planes X1, X2, X3, . . . , XN divide the repositioning portion into two identical portions.

In the embodiment shown in FIG. 20, the repositioning portion 160 has a partially disk shape or partially cylindrical shape having an exterior surface 166 that is partially circular in shape. The repositioning portion 160 has a center 168 about which the exterior surface 166 extends. The repositioning portion 160 has a plurality of different radii extending from the center 168 to the exterior surface 166. In the embodiment shown in FIG. 20, the repositioning portion 160 has a radius R1 spanning more than 180 degrees of the exterior surface 166, and the repositioning portion 160 has shorter radii R2, R3, R4, R5, R6, R7, . . . , RN spanning the remainder of the exterior surface 166. In an embodiment, these shorter radii decrease in length as progressing from radius R1 to radius RN, however the decrease occurs nonlinearly due to the asymmetric shape of the repositioning portion 160.

As described below, the archer can rotate the repositioning portion 160 through a rotational travel, which causes the exterior surface 166 to gradually reposition or pivot the trigger 126 for fine-tune adjusting. For example, if the repositioning portion 160 undergoes a rotational travel of three hundred and sixty degrees divisible by segments of ninety degrees, the travel through such segments will cause the trigger 126 to be moved by varying or different magnitudes. This is due to the asymmetry of the exterior surface 160.

Figure 22:
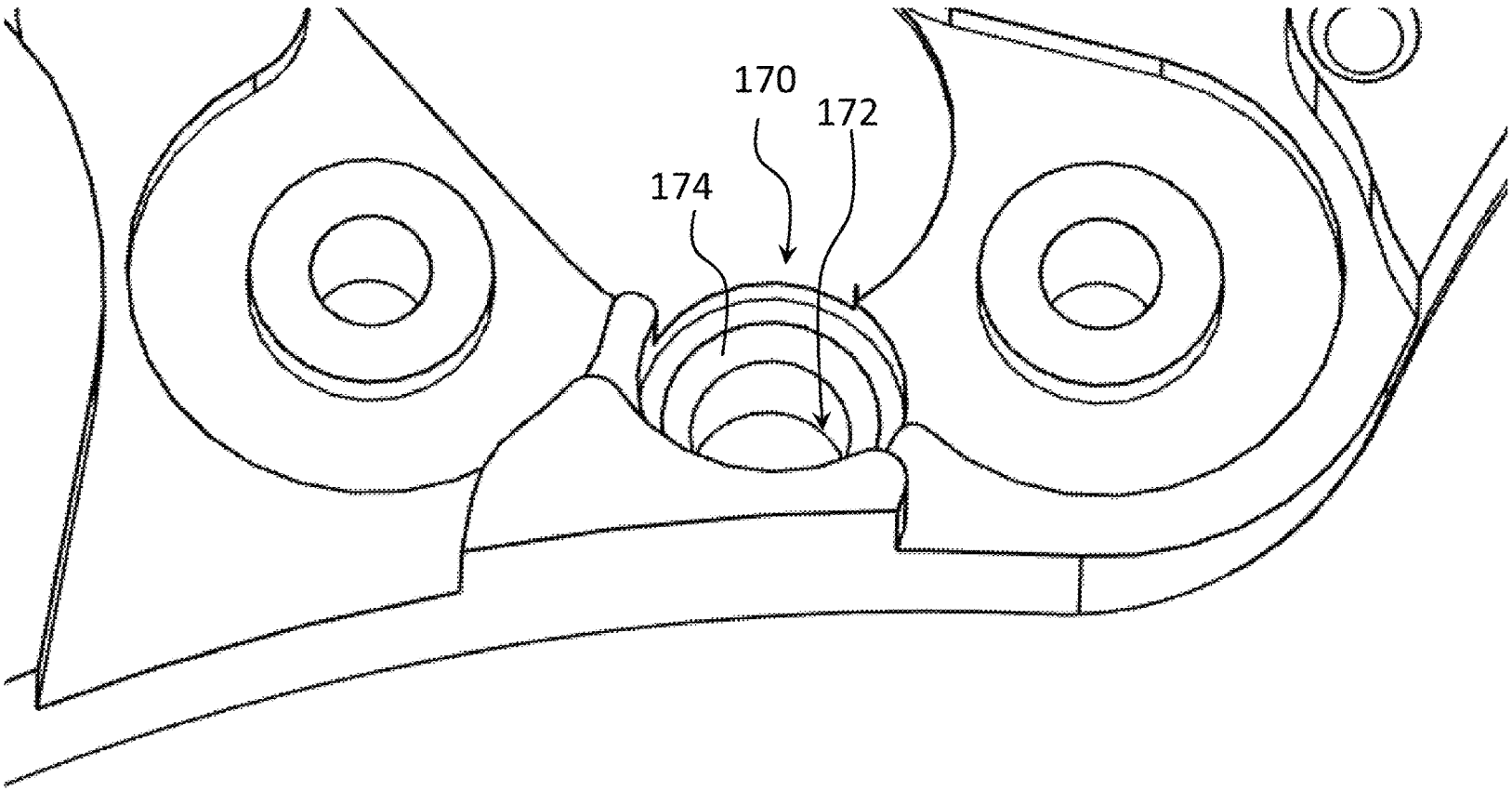
FIG. 22 is a close-up view of the structure of the embodiment of FIG. 21.
Figure 23:
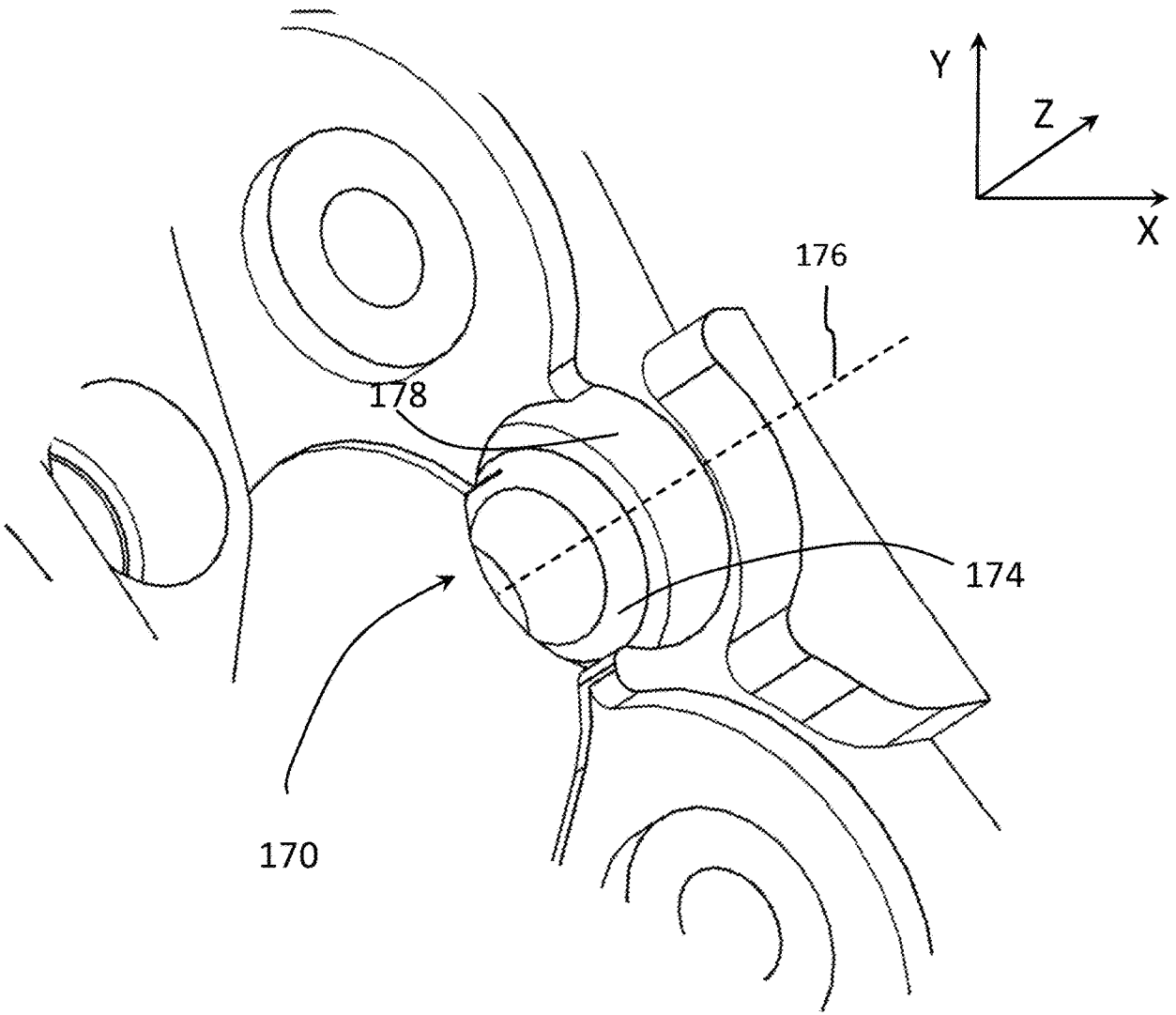
FIG. 23 is another close-up view of the structure of FIGS. 21 and 22.

Referring to FIGS. 4 and 22-23, the right side panel 114 has a structure 170 that defines a bore, passageway or channel 172 that provides the archer with access to the head 152 of the archery trigger adjuster 150. Also, the structure 170 is configured to mate with and engage the head 152 when the right and left side panels 114, 116 are fastened together. In the embodiment shown, the structure 170 has a stepped shape including a chamfered, slanted or angled retaining surface 174, conical in shape, that is shaped to engage the angled head surface 156 of the head 152 of the archery trigger adjuster 150. In an embodiment, the angled retaining surface 174 extends along an angle relative to axis 176, and the angled head surface 156 extends along the same angle relative to axis 176. The structure 170 also has a side retaining surface 178 configured to engage the side surface 158 (see FIGS. 15 and 17) of the head 152 (see FIGS. 15 and 17) of the archery trigger adjuster 150.

Figure 24:
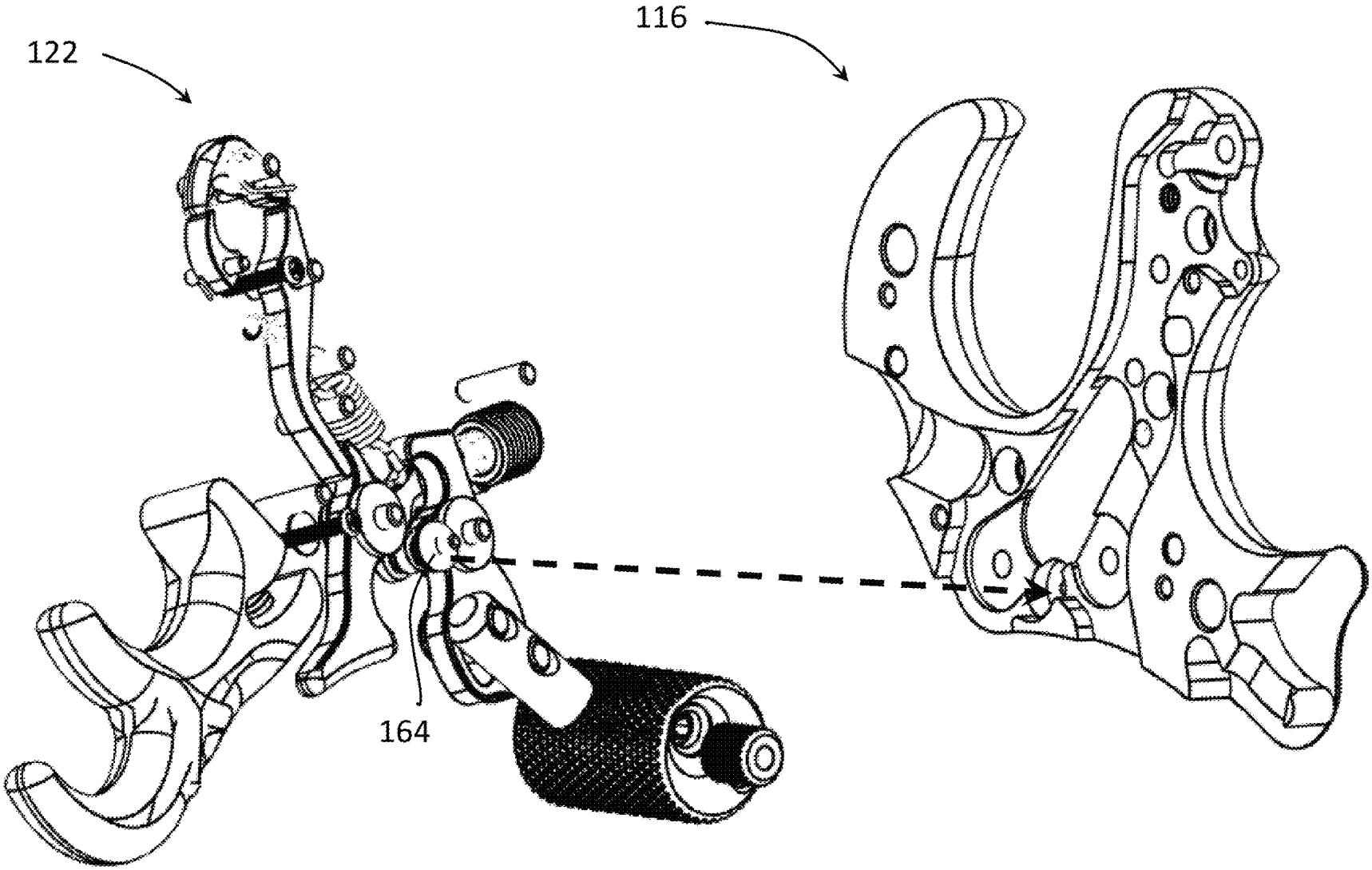
FIG. 24 is a isometric view of the left side panel of the housing separated from the linkage assembly.
Figure 25:
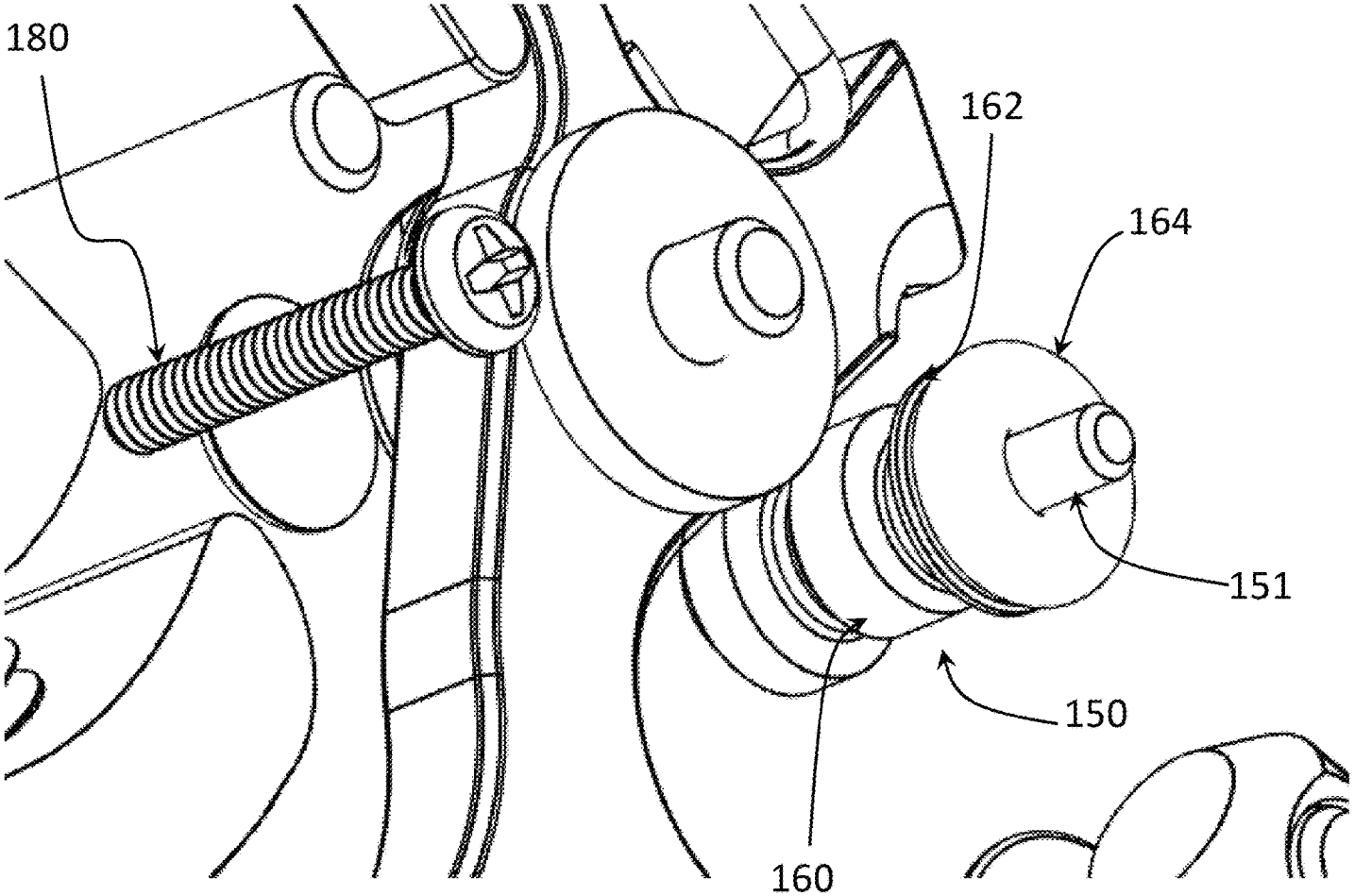
FIG. 25 is a close-up view of a fastener configured to couple the right and left side panels of the body together to compress the biasing member of the trigger adjuster.
Figure 26:
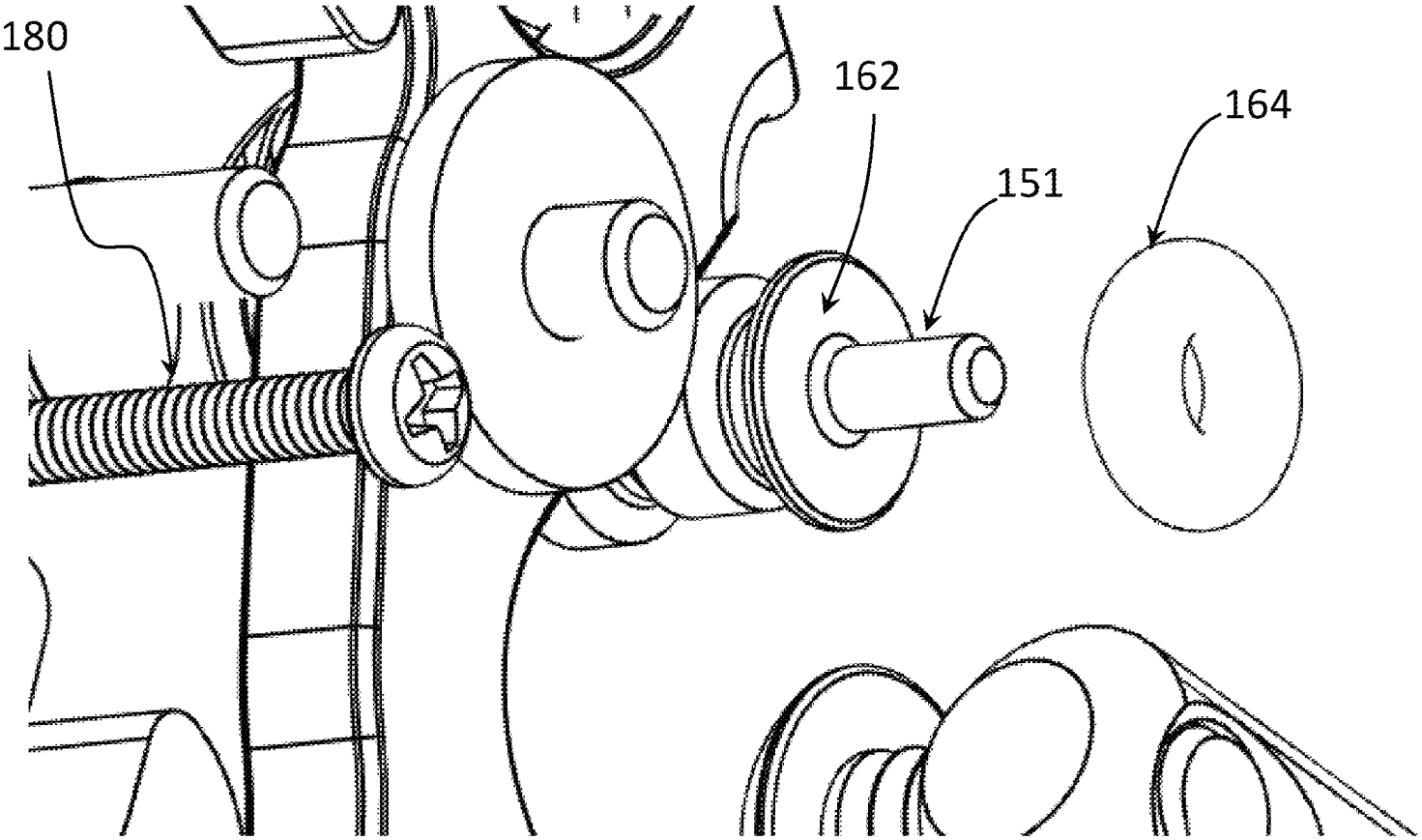
FIG. 26 is a different isometric view of the embodiment of FIG. 25, illustrating that the biasing element is separated from the trigger adjuster.

As shown in FIGS. 24-26, the biasing member 164 is positioned between the retainer 162 and the left side panel 116. When the right and left side panels 114, 116 are fastened together through suitable fasteners, such as screw 180, the left side panel 116 compresses the biasing member 164. In response, because of the elastic or spring characteristics of the biasing member 164, the biasing member 164 applies a spring or biasing force to the retainer 162, which, in turn, transmits that force to the head 152. As such, the head 152 is forced into a mated position with the structure 170. The biasing member 164 is sized and configured to generate a level of force that is: (a) sufficient to keep the head 152 mated; (b) sufficient to prevent the head 152 from unintentionally rotating during transportation or use of the archery release device 110; and (c) low enough to enable the archer to rotate the head 152 using a suitable tool, such as an Allen wrench or screw driver.

When the head 152 is mated with the structure 170, the structure prevents or otherwise impedes the archery trigger adjuster 150 from translating along the X, Y or Z axis (see FIGS. 2 and 3), limiting the movement of the archery trigger adjuster 150 to rotation.

Referring back to FIGS. 6-8, 13-17 and 20 in an example method of adjustment, the archer may desire to increase the trigger lag time by a minor amount. To do so, the user an insert an Allen wrench into the tool receiver 154 of the head 152. The user can then rotate the head 152 clockwise 148 until the trigger 126 pivots clockwise to a position desired by the archer. The clockwise movement of the trigger 126 will increase the extent of the overlap between the trigger action interface 127 and the hammer action interface 133, thereby increasing the trigger lag time. Starting from a position having a radius of R1 as shown in FIG. 20, when the user rotates the head 152 clockwise, the trigger adjustment interface 121 rides along the exterior surface 166 of the repositioning portion 160 causing the trigger 126 to pivot relative to the body 112 and the hammer 130. The asymmetric shape of the exterior surface 166 causes the trigger 126 to pivot with non-linear responsiveness.

For example, when the user rotates the head 152 counterclockwise by a first magnitude that results in a first amount of rotational travel, the trigger 126 pivots by a first amount. Likewise, when the user rotates the head 152 counterclockwise by a second magnitude that results in a second amount of rotational travel, the trigger 126 pivots by a second amount. In the case of the prior art, when the first and second magnitudes are equal and the first and second amounts of rotational travel are equal, and the first amount of pivot is equal to the second amount of pivot. In contrast, the archery trigger adjuster 150 provides the benefit of non-linear responsiveness. When the first and second magnitudes are equal and the first and second amounts of rotational travel are equal, then the first amount of pivot is unequal to the second amount of pivot. This non-linear responsiveness caused by rotation of the archery trigger adjuster 150 can gradually change the extent of the overlap between the trigger action interface 127 and the hammer action interface 133 as the radius of the repositioning portion 160 changes from R1 to R2, R3, . . . , RN. Also, this non-linear responsiveness can abruptly change the extent of the overlap between the trigger action interface 127 and the hammer action interface 133 as the radius of the repositioning portion 160 changes. This provides greater freedom and control for varying the trigger responsiveness.

In another example method of adjustment, the archer may desire to decrease the trigger lag time by a minor amount. To do so, the user an insert an Allen wrench into the tool receiver 154 of the head 152. The user can then rotate the head 152 counterclockwise 146 until the trigger 126 pivots with non-linear responsiveness in a counterclockwise direction to a position desired by the archer. The clockwise movement of the trigger 126 will decrease the extent of the overlap between the trigger action interface 127 and the hammer action interface 133, thereby decreasing the trigger lag time.

The archery trigger adjuster 150 enables archers to fine-tune the trigger lag time. The continuous, asymmetric contour of the repositioning 160 provides archers with greater level of control over the adjustment of the trigger 126. The asymmetric shape of the exterior surface 166 of the repositioning portion 160 enables the user to pivot the trigger 126 with non-linear control resulting in much finer adjustment capabilities over prior art devices.

It should be appreciated that, in other embodiments, the archery trigger adjuster 150 can be included in a variety of archery devices and accessories (including sight devices) as well as machines and apparatuses outside of the field of archery.

In an embodiment, there is a kit of different archery trigger adjusters 150. Each adjuster in the kit has a different exterior shape associated with a designated preference for archers.

The parts, components, and structural elements of the archery release device 110 (and each of its parts) can be combined into an integral or unitary, one-piece object through welding, soldering, plastic molding other methods, or such parts, components, and structural elements can be distinct, removable items that are attachable to each other through screws, bolts, pins and other suitable fasteners.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with, fit with or otherwise interlock with each other.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery trigger adjuster comprising:

a tool interface portion that is compatible with a portion of an adjustment tool; and a repositioning portion coupled to the tool interface portion, wherein the repositioning portion comprises:

a first surface configured to engage a trigger surface of a trigger of an archery release device; and an asymmetrical shape that is at least partially defined by the first surface, wherein the repositioning portion is configured to at least partially rotate in response to the tool interface portion being rotated, wherein the repositioning portion is configured to undergo a rotational travel that comprises a plurality of rotational movements that are equal in magnitude, wherein, when the first surface is engaged with the trigger surface, the first surface is configured so that, during the rotational travel, the plurality of rotational movements cause different amounts of pivoting responses by the trigger.

2. The archery trigger adjuster of claim 1, wherein the pivoting responses comprises:

a first pivoting amount by the trigger in response to a first one of the rotational movements of the repositioning portion; and a second pivoting amount by the trigger in response to a second one of the rotational movements of the repositioning portion, wherein the first and second pivoting amounts are unequal.

3. The archery trigger adjuster of claim 1, further comprising a head, wherein the head comprises an angled head surface, and wherein the tool interface portion is integral to the head.

4. The archery trigger adjuster of claim 3, further comprising an extension member extending from the head.

5. The archery trigger adjuster of claim 4, further comprising a retainer coupled to the repositioning portion.

6. The archery trigger adjuster of claim 5, further comprising a biasing member configured to be received by the extension member and abut the retainer.

7. The archery trigger adjuster of claim 1, wherein the repositioning portion is configured so that the rotational travel in a first direction increases an overlap between a portion of the trigger and a hammer of the archery release device, thereby increasing a delay between a trigger actuation and a release of a draw cord.

8. An archery trigger adjuster comprising:

a tool interface portion configured to interface with a portion of an adjustment tool; and a repositioning portion coupled to the tool interface portion, wherein the repositioning portion comprises a surface configured to engage a trigger surface of a trigger of an archery release device, wherein the surface of the repositioning portion comprises an asymmetrical shape.

9. The archery trigger adjuster of claim 8, further comprising a head, wherein the head comprises an angled head surface, and wherein the tool interface portion is integral to the head.

10. The archery trigger adjuster of claim 9, further comprising an extension member extending from the head.

11. The archery trigger adjuster of claim 10, further comprising a retainer coupled to the repositioning portion.

12. The archery trigger adjuster of claim 11, further comprising a biasing member configured to be received by the extension member and abut the retainer.

13. An archery release device comprising:

the archery trigger adjuster of claim 8;

a body that supports the trigger and the archery trigger adjuster, wherein the body comprises a plurality of finger interface surfaces; and a cord holder configured to be operatively coupled to the trigger.

14. The archery trigger adjuster of claim 8, wherein:

the repositioning portion is configured to undergo a rotational travel that comprises a plurality of rotational movements that are equal in magnitude, when the surface is engaged with the trigger surface, the surface is configured so that, during the rotational travel, the plurality of rotational movements cause different amounts of pivoting responses by the trigger.

15. The archery trigger adjuster of claim 14, wherein the pivoting responses comprises:

a first pivoting amount by the trigger in response to a first one of the rotational movements of the repositioning portion; and a second pivoting amount by the trigger in response to a second one of the rotational movements of the repositioning portion, wherein the first and second pivoting amounts are unequal.

16. A method of manufacturing an archery trigger adjuster, comprising:

structuring a tool interface portion to be interfaced with a portion of an adjustment tool; and structuring a repositioning portion to comprise a surface so that:

the surface is configured to engage a trigger surface of a trigger of an archery release device; and the surface comprises an asymmetrical shape; and coupling the repositioning portion to the tool interface portion.

17. The method of claim 16, further comprising:

structuring a head to comprise an angled head surface; and structuring the tool interface portion to be integral with the head.

18. The method of claim 17, further comprising structuring an extension member to extend from the head.

19. The method of claim 16, comprising:

structuring the repositioning portion to undergo a rotational travel that comprises a plurality of rotational movements that are equal in magnitude; and structuring the surface so that, when the surface is engaged with the trigger surface during the rotational travel, the plurality of rotational movements cause different amounts of pivoting responses by the trigger.

20. The method of claim 19, comprising structuring the repositioning portion so that the pivoting responses comprise:

a first pivoting amount by the trigger in response to a first one of the rotational movements of the repositioning portion; and a second pivoting amount by the trigger in response to a second one of the rotational movements of the repositioning portion, wherein the first and second pivoting amounts are unequal.

* * * * *